US012221247B2

(12) United States Patent
Carson

(10) Patent No.: US 12,221,247 B2
(45) Date of Patent: Feb. 11, 2025

(54) CAN END

(71) Applicant: Ball Corporation, Broomfield, CO (US)

(72) Inventor: Charles H. Carson, Westminster, CO (US)

(73) Assignee: BALL COPORATION, Westminster, CO (US)

( * ) Notice: Subject to any disclaimer, the term of this patent is extended or adjusted under 35 U.S.C. 154(b) by 33 days.

(21) Appl. No.: 18/010,687

(22) PCT Filed: Jun. 16, 2021

(86) PCT No.: PCT/US2021/037636

§ 371 (c)(1),
(2) Date: Dec. 15, 2022

(87) PCT Pub. No.: WO2021/257709

PCT Pub. Date: Dec. 23, 2021

(65) Prior Publication Data

US 2023/0227205 A1 Jul. 20, 2023

Related U.S. Application Data

(60) Provisional application No. 63/039,711, filed on Jun. 16, 2020.

(51) Int. Cl.

| | |
|---|---|
| ***B65D 17/28*** | (2006.01) |
| ***B65D 51/00*** | (2006.01) |
| ***B65D 51/22*** | (2006.01) |

(52) U.S. Cl.

CPC ..... *B65D 17/4014* (2018.01); *B65D 51/007* (2013.01); *B65D 51/222* (2013.01);
(Continued)

(58) Field of Classification Search

CPC ..... B65D 17/4014; B65D 51/007; B65D 51/222; B65D 2517/0014;
(Continued)

(56) References Cited

U.S. PATENT DOCUMENTS 4,717,039 A * 1/1988 Ayyoubi ..... B65D 47/265 220/253
4,834,258 A * 5/1989 Root ..... B65D 47/265 220/269

(Continued)

FOREIGN PATENT DOCUMENTS

AU 2011259117 B2 1/2013
CA 2800466 C 2/2018

(Continued)

OTHER PUBLICATIONS

International Search Report and Written Opinion dated Sep. 28, 2021; priority document.

(Continued)

*Primary Examiner* — James N Smalley
(74) *Attorney, Agent, or Firm* — Greer, Burns & Crain, Ltd.

(57) ABSTRACT

A can end (10) has a curl (14) extending circumferentially about a longitudinal axis (50). A circumferential wall (15) extends downwardly. A strengthening member (16) is joined to lower segment of the circumferential wall (15). A center panel (12) extends radially inwardly from the circumferential strengthening member (16). A rivet (38) attaches a tab (28) to the center panel (12). A cover (60) is attached to the tab (28) and is rotation therewith. A frangible score (24) in the center panel (12) is breakable to form a pour opening (27) in the center panel (12). The cover (60) is rotatable to
(Continued)

overlay the pour opening (27) and effectively reclose the pour opening (27) in a reclosed condition of the can end (10).

19 Claims, 21 Drawing Sheets

(52) U.S. Cl.
CPC ..... *B65D 2517/0014* (2013.01); *B65D 2517/0044* (2013.01); *B65D 2517/0061* (2013.01)

(58) Field of Classification Search
CPC .... B65D 2517/0044; B65D 2517/0061; B65D 2517/0062; B65D 2517/007; B65D 2517/0076
See application file for complete search history.

(56) References Cited

U.S. PATENT DOCUMENTS

| | | | | |
|---|---|---|---|---|
| 4,852,763 | A * | 8/1989 | Dimberio | B65D 47/265 D9/518 |
| 4,887,712 | A * | 12/1989 | Wells | B65D 17/4014 206/269 |
| 5,813,559 | A * | 9/1998 | Cho | B65D 17/4014 220/269 |
| 6,098,830 | A | 8/2000 | Jamieson | |
| 8,608,007 | B2 | 12/2013 | Seo | |
| 2005/0051553 | A1* | 3/2005 | Li | B65D 17/4014 220/730 |
| 2005/0115969 | A1* | 6/2005 | Mizuma | B65D 17/4014 220/269 |
| 2006/0163254 | A1 | 7/2006 | Wichelhaus | |
| 2012/0031056 | A1* | 2/2012 | Chasteen | B65D 17/4012 220/269 |
| 2012/0285962 | A1 | 11/2012 | Seo | |
| 2015/0225138 | A1* | 8/2015 | Harris | B65D 43/18 220/820 |
| 2019/0283930 | A1 | 9/2019 | Schuver | |

FOREIGN PATENT DOCUMENTS

| | | | |
|---|---|---|---|
| CN | 102712386 | B | 10/2012 |
| EP | 2578507 | B1 | 10/2015 |
| ES | 2552353 | T3 | 11/2015 |
| FR | 3056562 | A1 | 3/2018 |
| JP | 2013530105 | A | 7/2013 |
| KR | 101013669 | B1 | 2/2011 |
| KR | 20110058992 | A | 6/2011 |
| KR | 101165758 | A | 12/2011 |
| KR | 20110130121 | A | 12/2011 |
| KR | 101166302 | A | 7/2012 |
| WO | 9722531 | A1 | 6/1997 |
| WO | 2011149207 | A2 | 12/2011 |

OTHER PUBLICATIONS

International Preliminary Report on Patentability and Written Opinion for International Patent Application No. PCT/US2021/037636 dated Dec. 13, 2022; priority document.

* cited by examiner

CAN END

CROSS-REFERENCE TO RELATED APPLICATIONS

This Application is a United States National Stage Application under 35 U.S.C. Section 371 of International Patent Application No. PCT/US2021/037636 filed on Jun. 16, 2021, which is hereby incorporated by reference as if fully set forth herein. This Application also claims priority to and the benefit of U.S. Provisional Application No. 63/039,711 filed on Jun. 16, 2020, which is also hereby incorporated by reference as if fully set forth herein.

FEDERALLY SPONSORED RESEARCH OR DEVELOPMENT

N/A

TECHNICAL FIELD

The invention relates to can ends attachable to can bodies; more particularly, the invention relates to a can end having a stay-on tab and cover for reclosing a pour opening on the can end.

BACKGROUND

Beverage container designers have developed many proposals for producing reclosable two-piece aluminum beverage containers having stay-on tab (SOT) ecology lids (can ends) wherein a portion of the contents can be saved for a later time. In the case of beverage cans, most of these inventions have required using a variation on a combination of materials, for example a displaceable polymeric insert mounted within a pour opening which provides an initially pressure resistant seal. None of these inventions have been commercially accepted on a widespread basis.

Recently, reclosable three-piece aluminum beverage containers have become popular in the energy drink market. These containers are reclosable by utilizing a lug-type closure added to the otherwise two-piece construction of the beverage container. Similarly, the beer market utilizes a two-piece aluminum beverage container with a threaded closure.

There are few commercial innovations in the field which combine a reclosable feature with a traditional SOT beverage can end. Fewer commercial innovations combine a reclosable cover with a rivetedly attached tab such that the cover rotates with the tab. Finally, there are no known commercial innovations that add complimentary features to the can end, tab and reclosable cover to create a leak-proof, reclosable can end.

Existing products in this space tend to leak at least a couple of drops after being reclosed. After leaking a couple of drops, surface tension provides a barrier to leakage None of the known commercial options have the universal and lightweight appeal of the SOT can end.

The present invention is provided to solve the problems discussed above and other problems, and to provide advantages and aspects not provided by prior can ends of this type. A full discussion of the features and advantages of the present invention is deferred to the following detailed description, which proceeds with reference to the accompanying drawings.

SUMMARY

One aspect of the invention is directed to a can end for enclosing a container body. The can end is configured to be reclosable after opening. A curl extends circumferentially about a longitudinal axis. A circumferential wall extends downwardly from a radially inner portion of the curl. A circumferential strengthening member is joined to lower segment of the circumferential wall. The circumferential strengthening member extends circumferentially about a center panel. The center panel has a public side opposite a product side. A peripheral edge defines a radially outer perimeter of the center panel. A tear panel is spaced radially inwardly from the peripheral edge and is defined by a frangible score in the public side and non-frangible hinge segment located between terminal ends of the frangible score. A tab is attached to the center panel by the rivet of the center panel. The tab is configured to rotate about the rivet. A lift end of the tab is opposite a nose portion which overlays the tear panel in a frangible score breaking position. A rivet island of the tab has a rivet aperture through which the rivet passes to attach the tab to the center panel. A void region partially surrounds the rivet island and has a first leg extending along a first side of the rivet island and a second leg extending along a second side of the rivet island. A tab hinge extends between respective terminal ends of the first and second legs of the void region. A cover is attached to the tab and is rotation therewith. The frangible score is breakable to form a pour opening in the center panel, and the cover is rotatable to overlay the pour opening and effectively reclose the pour opening in a reclosed condition of the can end.

This aspect of the invention may include one or more of the following features, alone or in any reasonable combination. The cover may be attached to the rivet island of the tab. The tab may comprise downwardly extending legs along the first and second sides of the rivet island defining a space between the public side of the center panel and a bottom side of the tab wherein the cover is positioned within the space. The tear panel may comprise an up-bead extending upwardly in a direction parallel to the longitudinal axis, the up-bead located beneath the nose portion of the tab. The center panel may comprise a down-bead on a side of the center panel opposite the tear panel in relation to the rivet, wherein the down-bead is positioned beneath the nose portion of the tab when the can end is in the reclosed condition and the down-bead is configured to receive a portion of the tab nose therein. The center panel may comprise a bead near the rivet and opposite the tear panel in relation to the rivet, wherein the bead is located beneath the rivet island of the tab when the can end is in the reclosed condition. The bead near the rivet may be an up-bead which engages one of the rivet island or the cover when the can end is in the reclosed condition. The bead near the rivet may be a down-bead which receives a portion of one of the rivet island or the cover when the can end is in the reclosed condition. The tear panel may comprise a down-bead located on an opposite side of the rivet as the bead near the rivet, and the down-bead on the tear panel is configured to receive a down-bead on one of the rivet island or the cover when the nose portion of tab is in the frangible score breaking position. The center panel may comprise a platform extending in one of an upwardly or downwardly direction parallel to the longitudinal axis, the platform displacing a portion of the center panel comprising the tear panel such that a height of the entirety of the tear panel in relation to a portion of the center panel immediately surrounding the rivet is located at a different height than the tear panel. The height of the entirety of the tear panel may be higher than a portion of the center panel immediately surrounding the rivet. The height of the entirety of the tear panel may be lower than a portion of the center panel immediately surrounding the rivet. The cover may engage the center panel along a region of the center panel surrounding the pour opening when the can end is in the reclosed condition. The cover may be located within the pour opening between the product side and the public side of the center panel when the can end is in the reclosed condition. The cover may comprise an intermediate member attached to the tab and a closure attached to the intermediate member and attached to the tab by attachment of the closure to the intermediate member such that the closure member is rotatable upon rotation of the tab. The closure may engage the center panel along a region of the center panel surrounding the pour opening when the can end is in the reclosed condition. The closure may be located within the pour opening between the product side and the public side of the center panel when the can end is in the reclosed condition. The closure may comprise a circumferential flange angled upwardly and radially outwardly relative to a center portion of the closure. The flange may contact a severed edge of the center panel created by a fracture of the frangible score during opening of the can end and which defines at least a portion of the pour opening. The flange may comprise a sealing material produced from at least one of an epoxy or polymeric material. The center panel may comprise a plurality of beads formed on a side of the center panel opposite the tear panel in relation to the rivet, wherein each bead of the plurality of beads is one of an up-bead or a down-bead, and each bead of the plurality of beads is positioned beneath the rivet island of the tab when the can end is in the reclosed condition. The cover may be attached to the rivet island by a rivet. The intermediate member may be attached to the tab by a rivet. The closure may be attached to the intermediate member by a rivet.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 2:
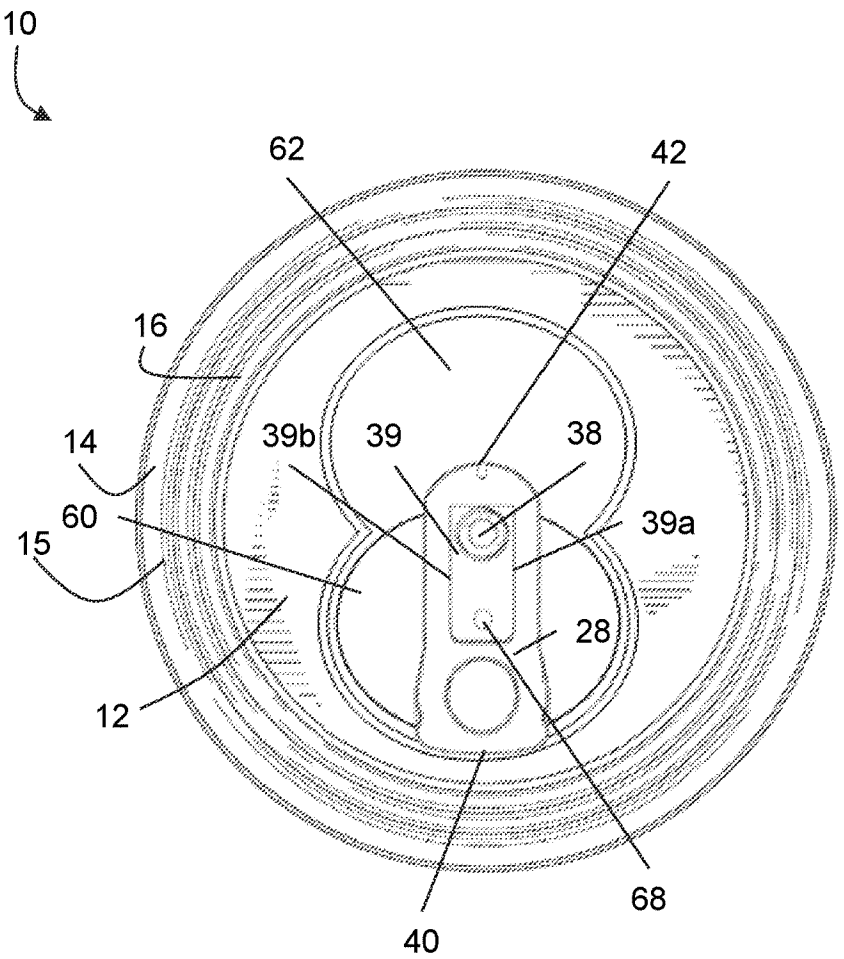
FIG. 2 is a top view of a can end having a reclosable cover with a tab and the cover rotated over a concealed pour opening to create a reclosed condition of the can end.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

An aspect of the present invention provides a leak-proof, reclosable can end for beverage containers. These can ends are produced from a metal or metal alloy and have a frangible score which is fractured to form a pour opening for drinking or pouring the contents of a container. A tab is affixed by a rivet to assist in the fracture of the frangible score. A cover is attached to the tab to reclose the pour opening. The cover, tab and can end have structural elements that are complimentary to the opening and reclosing process.

The present disclosure includes a lift end of a tab configured to be being lifted by a user in a typical fashion to break a frangible score, thusly forming a pour opening or aperture. Once the pour opening is created, the tab can be rotated across or along an upper surface of the can end to move a cover into a position where it closes the pour opening.

Figure 4:
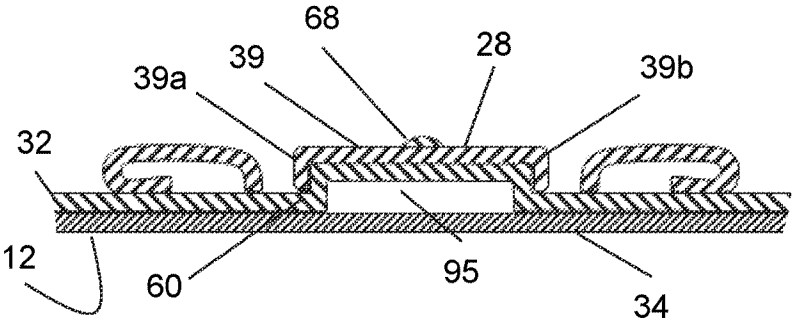
FIG. 4 is a cross-sectional view of a tab taken along the IV-IV of FIG. 1.

In one embodiment, the tab has decorations or ideograms to inform the consumer that the can end is reclosable by rotating the tab. This could be accomplished with embossing, incising, a metal cutout, laser etching, etc. The tab can also have additional structure elements configured to improve the reclosability of the cover. These structural elements would turn a rivet island from a strip to a beam (see FIG. 4). This will be described in more detail below.

In one embodiment, the information or instructions for operating the reclosable end and tab are printed on the can end.

The cover can be joined to the tab in several ways. For example. A rivet in the cover or a receiving hole for a rivet can be formed. The cover can also be joined by any other means of joining materials including, but not limited to, heat sealing, epoxy, adhesives, welding or crimping.

In an embodiment, the cover is a continuous form of metal such that the tab and cover are formed from a single metal cutout. This results in a fully integral tab/cover relationship whereon the tab and the cover are produced simultaneously during the same forming operation.

In an embodiment, the cover has a material joined to a surface to promote a leak proof reclosed position, e.g. a plastic elastomer or laminate annular or semi-annular ring or disk.

In an embodiment, the cover has downwardly extending protrusions which approach towards an upper surface of the can end to better reclose the can end after the can end is plastically deformed from breaking the frangible score.

In an embodiment, the can end has protrusions formed entirely or partially around the frangible score which reduce plastic deformation of the can end during the breaking of the frangible score.

In an embodiment, the can end has protrusions formed in it so as to indicate to the user that the tab has been rotated into a reclosing position.

In one embodiment, the cover is not fixedly attached to the tab and does not rotate therewith. The cover is independently rotatable in relation to the tab.

Figure 1:
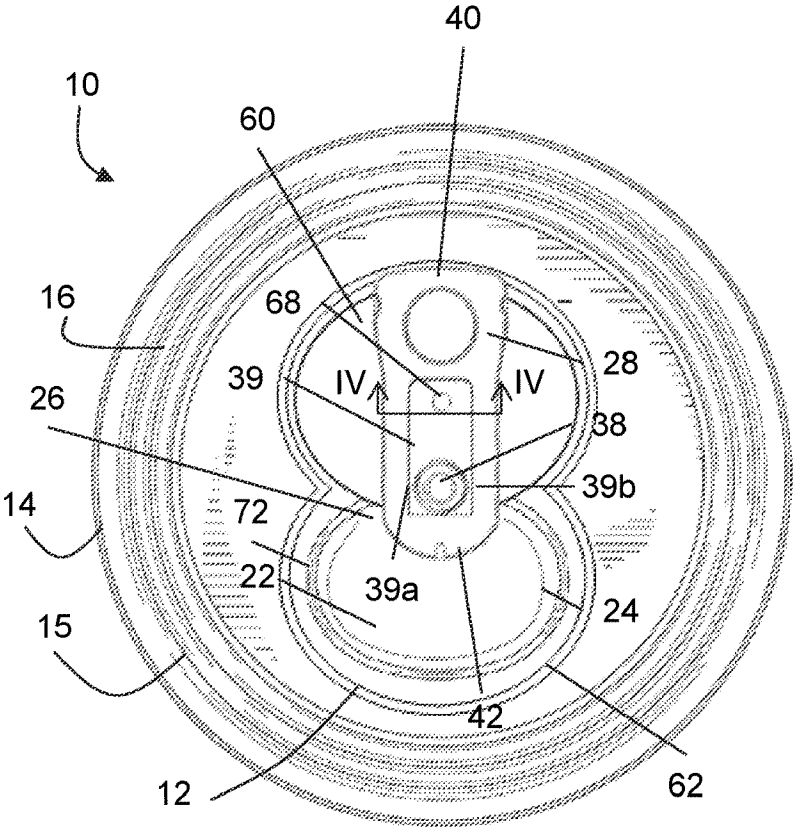
FIG. 1 is a top view of a can end having a reclosable cover with a tab in a ready-to-open, frangible score breaking position.

Referring to FIG. 1, a reclosable beverage can end 10 for containers (not shown) has a center panel 12 separated from a seaming curl 14 by a circumferential wall 15 extending downwardly from the seaming curl 14 to a strengthening segment 16 which is joined to the center panel 12. The container is typically a drawn and ironed metal can, usually constructed from a thin plate of aluminum or steel. Beverage can ends for such containers are also typically constructed from a cut edge of thin plate of aluminum or steel, formed into blank end, and manufactured into a finished end by a process often referred to as end conversion.

The can end 10 can be joined to a container body by the seaming curl 14 which is joined to a mating curl of the container body. The seaming curl 14 of the can end 10 is integral with the center panel 12 by the circumferential wall 15 and the strengthening segment 16, typically either a generally U-shaped countersink or a fold, which is joined to a peripheral edge of the center panel 12, which defines an outer perimeter of the center panel 12, often through an additional strengthening feature such as a circumferential step or other circumferential wall.

The circumferential seaming curl 14 defines an outer perimeter of the beverage can end 10. It is generally centered about a longitudinal or vertical axis 50, sometimes located at a center of a rivet.

The circumferential wall 15 extends downwardly from a radially inner portion of the seaming curl 14.

The circumferential strengthening segment 16 is joined to a lower segment of the circumferential wall 15 and extends circumferentially about the center panel 12.

The center panel 12 has a means for opening the end 10. The means for opening the can end 10 may include a displaceable foil closure member or, as shown in FIGS. 1 and 2, a tear panel 22 defined by a curvilinear frangible score 24 and a non-frangible hinge segment 26 which extends between terminal ends of the frangible score 24. Accordingly, the hinge segment 26 is defined by a generally straight line between a first end and a second end of the frangible score 24.

The tear panel 22 of the center panel 12 may be opened, that is the frangible score 24 may be severed and the tear panel 22 displaced at an angular orientation relative to the remaining portion of the center panel 12, while the tear panel 22 remains hingedly connected to the center panel 12 through the hinge segment 26. In this opening operation, the tear panel 22 is displaced at an angular deflection, as it is opened by being displaced away from the plane of the panel 12. This deflection of the tear panel 22 creates a pour opening 27 through which a fluid in the container can be poured.

The frangible score 24 is preferably a generally V-shaped groove formed into a public side 32 of the center panel 12. A residual is formed between the V-shaped groove and a product side 34 of the end member 10.

The end member 10 has a tab 28 secured to the center panel 12 adjacent the tear panel 22 by a rivet 38 which passes through an aperture in a rivet island 39 of the tab 28.

The rivet 38 is formed in the typical or customary manner well known in the art of can end manufacture.

A nose portion 42 of the tab 28 overlays the tear panel 22 in a frangible score breaking position. During opening of the can end 10, the user lifts a lift end 40 of the tab 28 to displace the nose portion 42 downward against the tear panel 22. The force of the nose portion 42 against the tear panel 22 causes the score 24 to fracture. As the tab 28 displacement is continued, the fracture of the score 24 propagates around the tear panel 22, preferably in progression from the first end of the score 24 toward the second end of the score 24.

The tab 28 has a void region which partially surrounds the rivet island 39. The void region has a first leg extending along a first side of the rivet island 39 and a second leg extending along a second side of the rivet island 39. The tab 28 comprises downwardly extending legs 39*a,b* along the first and second sides of the rivet island 39 which defining a space between the public side 32 of the center panel 12 and a bottom side of the tab 28. A portion of a cover 60 is received within the space as will be clear from the disclosure.

A tab hinge extends between respective terminal ends of the first and second legs of the void region. The tab 28 bends about the tab hinge during the opening process.

As shown in, for example, FIGS. 1-3 and 7A-15, the frangible score 24, tab 28, and cover 60 can be recessed within a deboss panel 62 in the center panel 12. The deboss panel 62 is a recessed surface in the center panel 12 which decreases a height of a portion of the center panel 12 in a direction parallel to the longitudinal axis 50 such that a concave surface is formed on the public side 32 of the can end 10.

Figure 3:
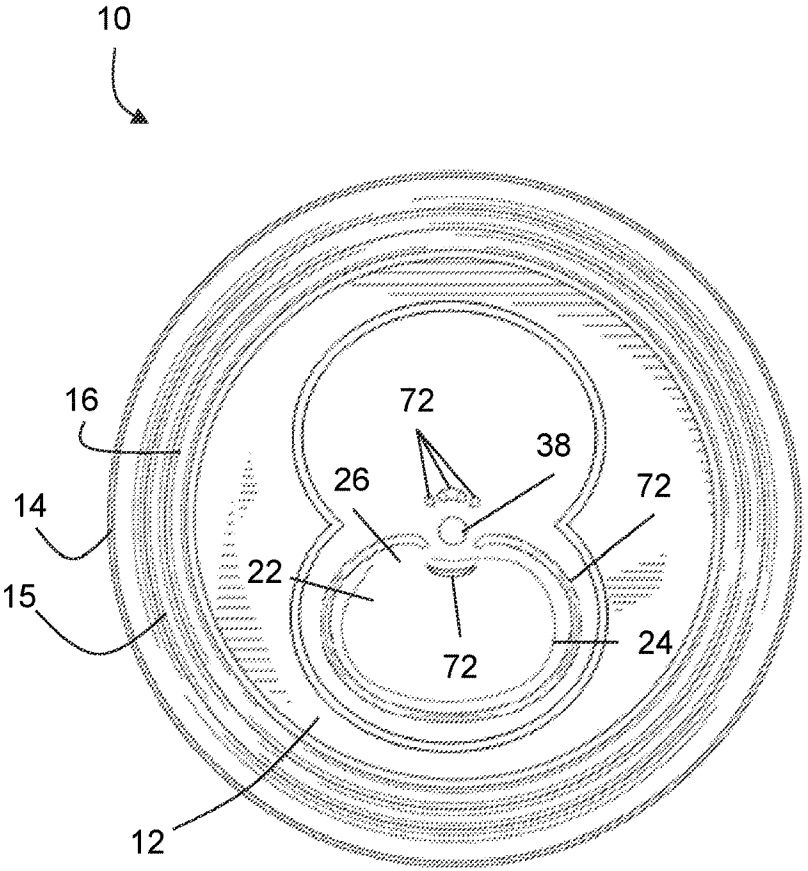
FIG. 3 is a top view of a can end with a tab and a cover removed to reveal beading which is configured to improve reclosability and reliable opening.
Figure 8:
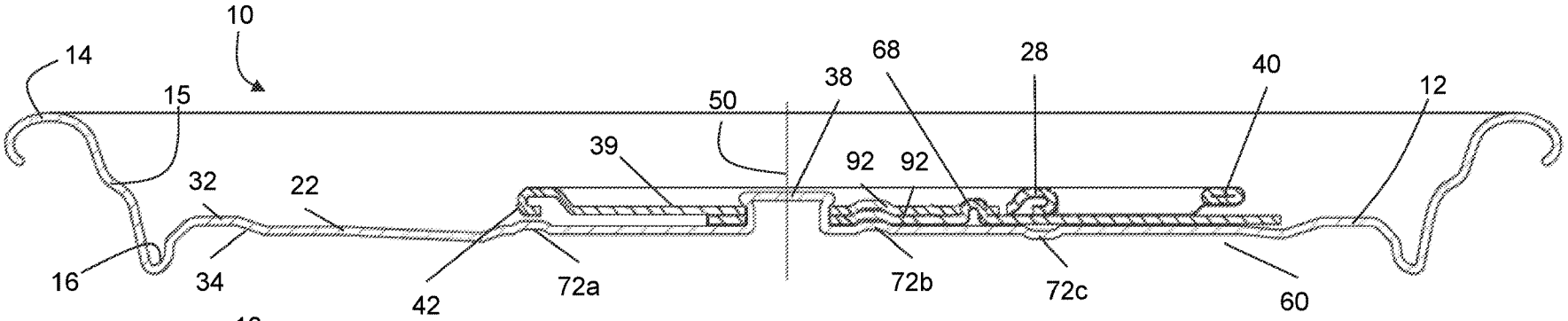
FIG. 8 is cross-section of an embodiment of a can end having a reclosable cover in a ready-to-open position ready-to-open, frangible score breaking position.

As shown in FIGS. 1-3, the deboss panel 62 has a snowman-shape or FIG. 8-shape. However, it is contemplated that the deboss panel 62 can take any shape such that the frangible score 24, the rivet 38, and, at least, the nose portion 42 of the tab 28 are recessed within the deboss panel 62. It is further contemplated that the lift end 40 of the tab 28 can extend beyond a boundary or periphery of the deboss panel 62 to ease accessibility of the lift end 40 by a user to improve the can end opening process.

As shown in FIGS. 1 and 2, the tab 28 of the present disclosure includes a cover 60 configured to be positioned over the pour opening 27 to desirably preserve any remaining fluid within the container when the can end is in a reclosed condition. The cover 60 is positioned over the pour opening 27 by rotating the tab 27 to place the cover 60 in the desire position over the pour opening 27. This rotation of the tab 60 is imparted to the cover 60 either via the cover 60 having been integrally formed with the tab 28 during the same metal forming process or by connection of the cover 60 to the tab 28. It follows that the cover 60 can also be rotated without manipulating the tab 60. Relative rotational movement between the tab 28 and the cover 60 will naturally occur upon rotating one of the tab 28 and the cover 60.

In one embodiment, the cover 60 has a shape that matches a shape of the frangible score 24.

Figure 28:
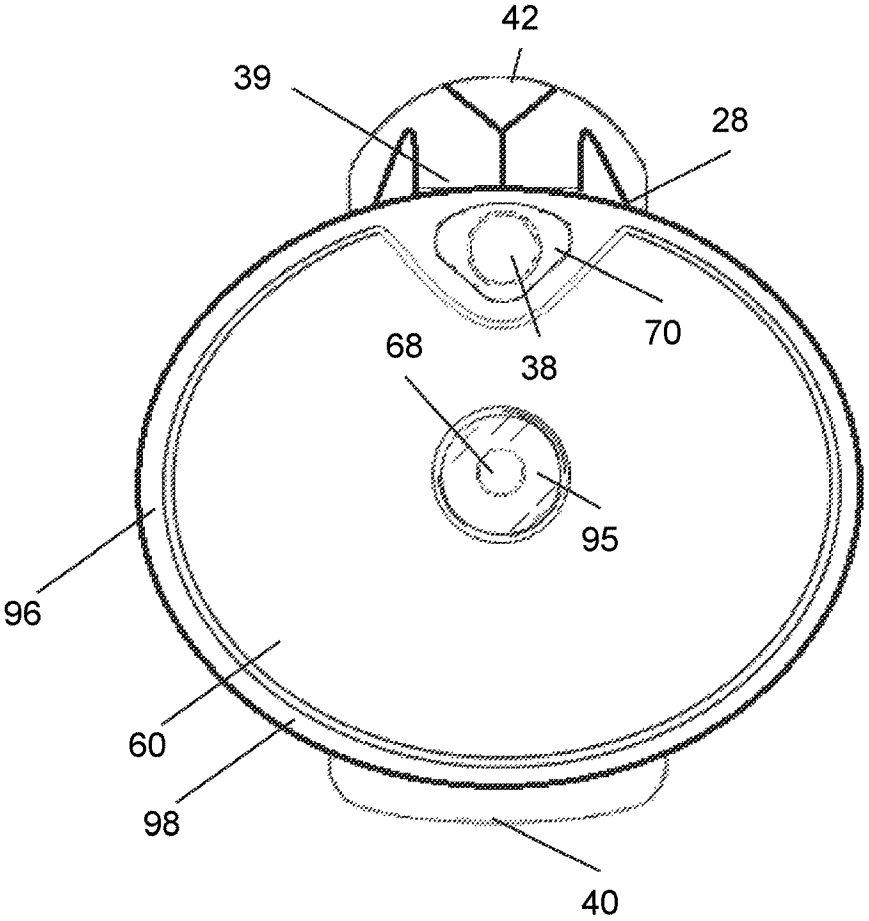
FIG. 28 is a bottom view of a tab which can be provided on a can end of the invention in a pour opening closed position.

The cover 60 can have a rivet aperture 70 through which rivet 38 passes. This aperture is typically round. Alternatively, the rivet aperture 70 can take an alternate shape, such as an out-of-round shape, for example, a half-moon or, as depicted in FIG. 28, a substantially triangular shape wherein intersections of triangle legs have a radius of curvature to eliminate sharp corners. Sharp corners are stress risers which can lead to cracks.

The aperture 70 can have a cross-sectional area that is larger than a cross-sectional area of the aperture in the rivet island 39 of the tab 28 through which the rivet 38 passes to stake the tab 28 to the center panel 12.

The aperture 70 can have a cross-sectional shape that is different than a cross-sectional shape of the aperture on the rivet island 39 of the tab 28 through which the rivet 38 passes to stake the tab 28 to the center panel 12.

In the reclosed condition of the can end 10, the cover 60 engages the center panel 12 along a region of the center panel 12 surrounding the pour opening 22. The cover 60 may be located within the pour opening 27 between the product side and the public side 32 of the center panel when the can end is in the reclosed condition.

Figure 29:
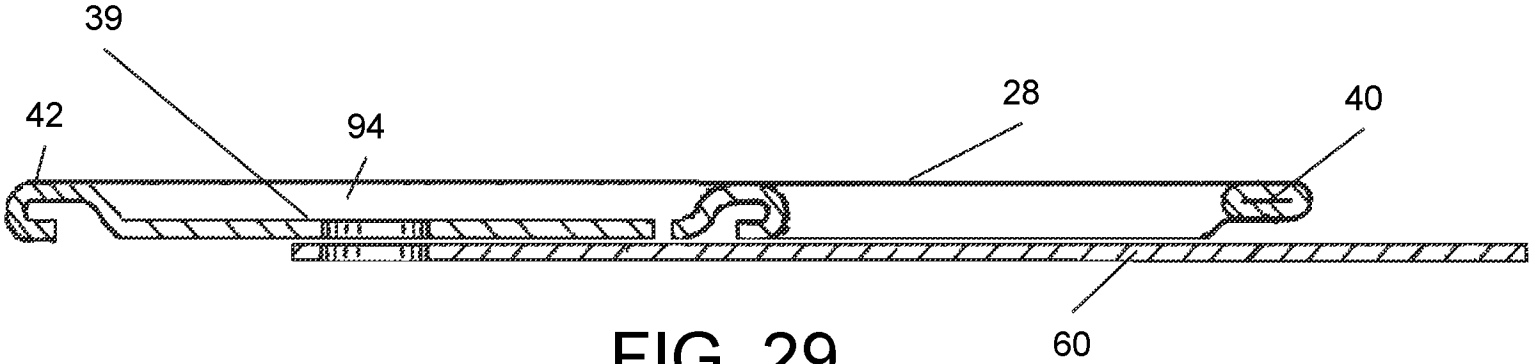
FIG. 29 is a cross-sectional view of a tab and cover wherein the cover is not fixed to the tab.
Figure 30:
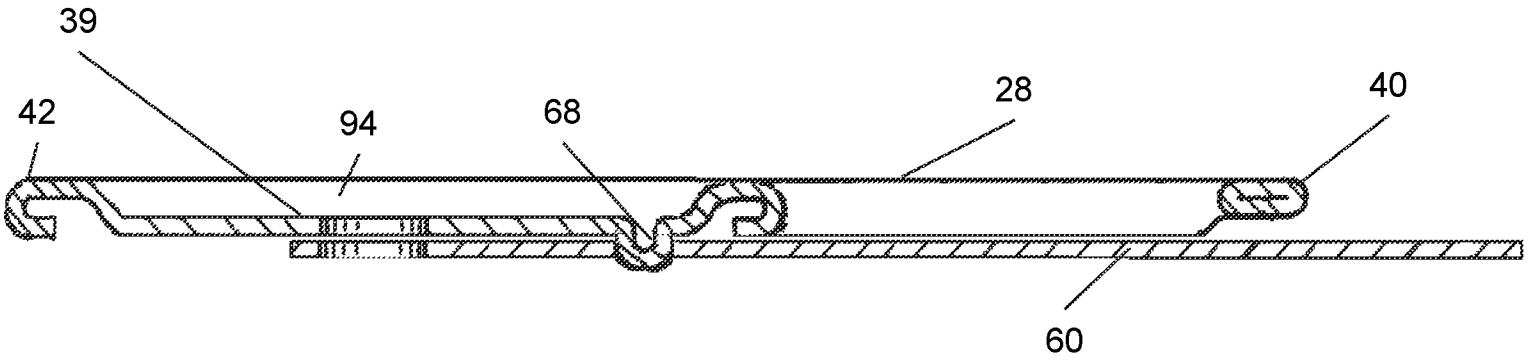
FIG. 30 is a cross-sectional view of a tab and cover wherein the cover is fixed to the tab by a rivet of the tab material.
Figure 31:
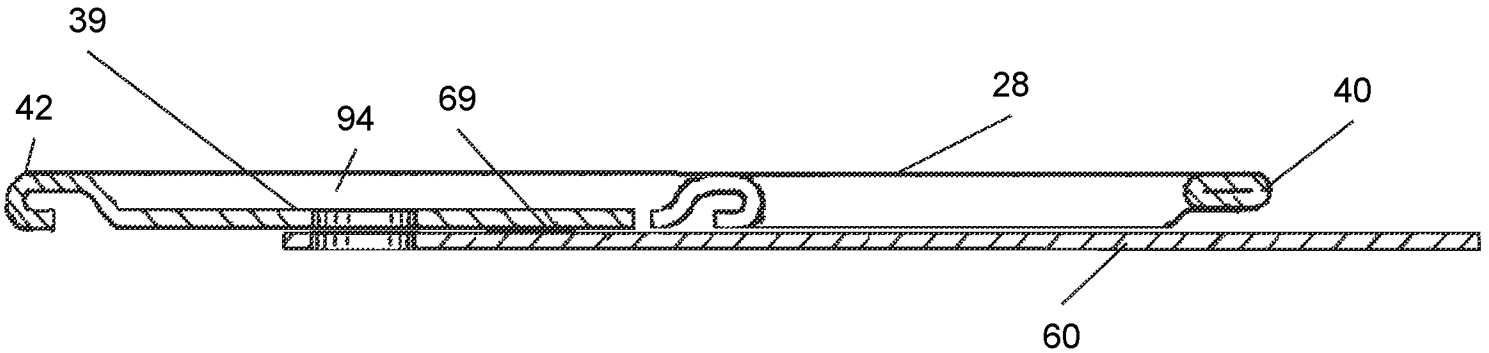
FIG. 31 is a cross-sectional view of a tab and cover wherein the cover is fixed to the tab by a spot weld or adhesive.
Figure 32:
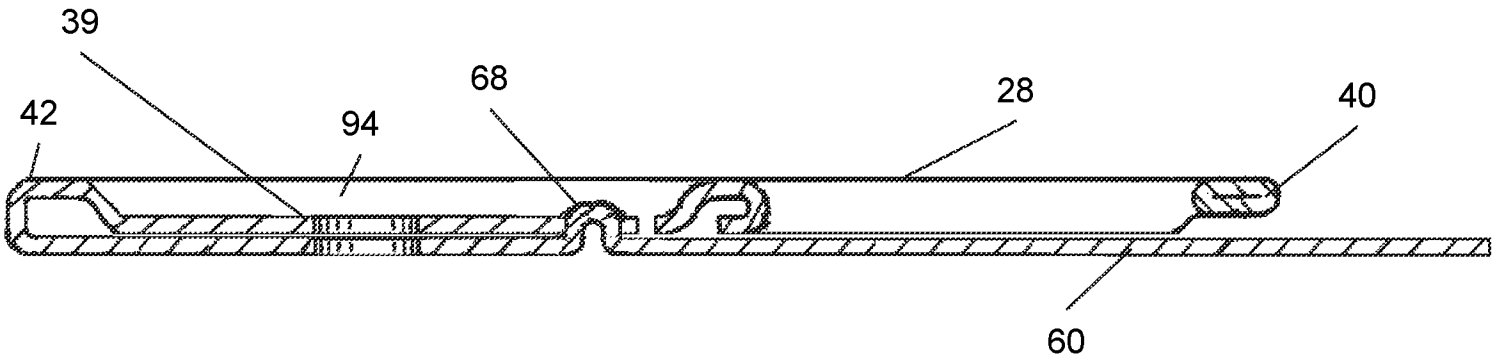
FIG. 32 is a cross-sectional view of a tab and cover wherein the cover is integrally formed with the tab in a one-piece construction.
Figure 37:
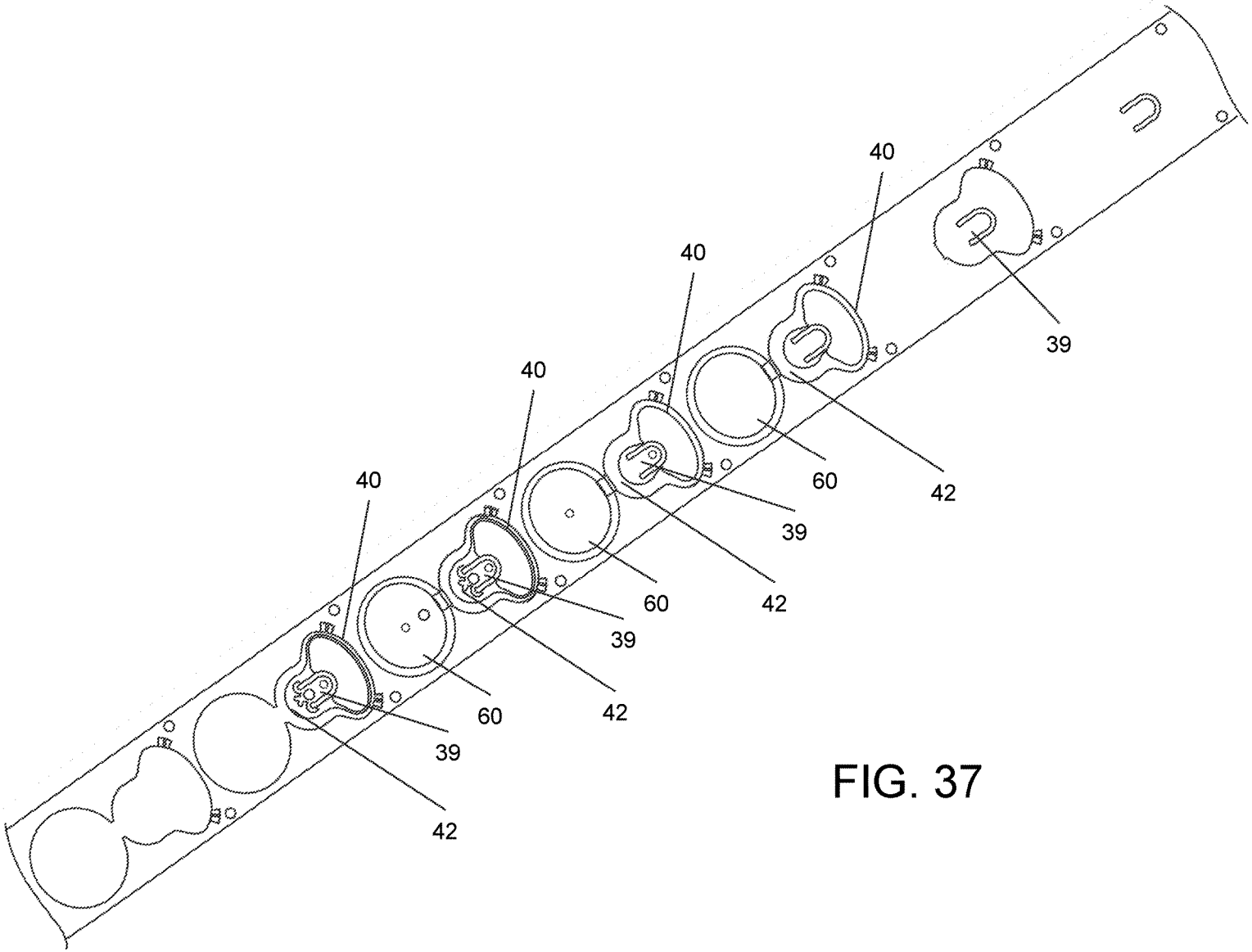
FIG. 37 is an example of a manufacturing sequence to produce a cover integrally formed with a tab.

An attachment fixes the cover 60 to the tab 28. Alternatively, the cover 60 can be integrally formed with the tab 28 during the tab forming process (see FIGS. 32 and 37) with or without a rivet attaching the cover 60 to the tab 28 in a one-piece construction. Optionally, the cover 60 is attached to the tab 28 by a rivet 68 which passes through a rivet aperture in the tab 28 wherein the rivet 68 is produced from the material of the cover 60, or the rivet 68 passes through a rivet aperture on the cover 60, and the rivet 68 is produced from the material of the tab 28 (see FIG. 30) or by a spot weld or adhesive 69 (see FIG. 31). Optionally, the cover 60 is not joined to the tab 28 such that it rotates independently of the tab 28 (see FIG. 29).

Figure 5:
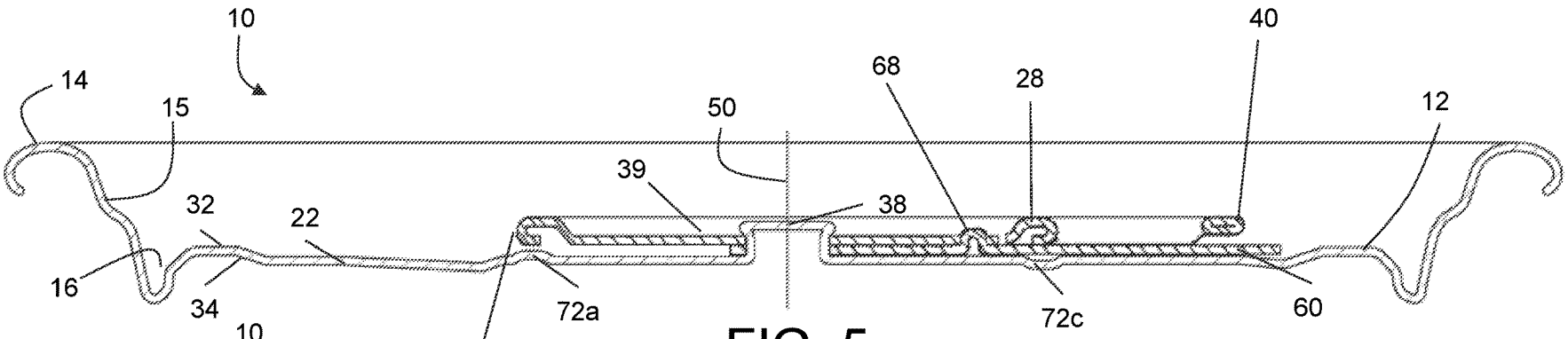
FIG. 5 is cross-section of an embodiment of a can end having a reclosable cover in a ready-to-open, frangible score breaking position.
Figure 6:
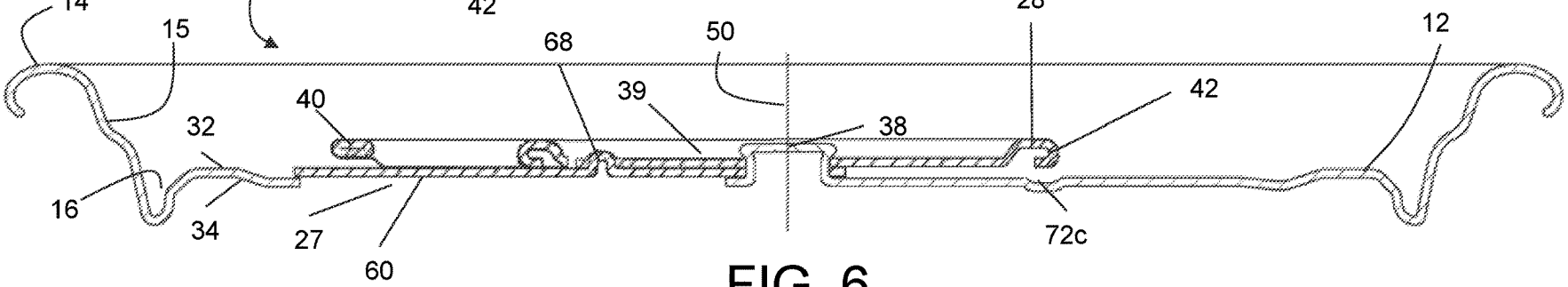
FIG. 6 is a cross-section of an embodiment of a can end having a reclosable cover in a pour opening closed position.
Figure 7A:
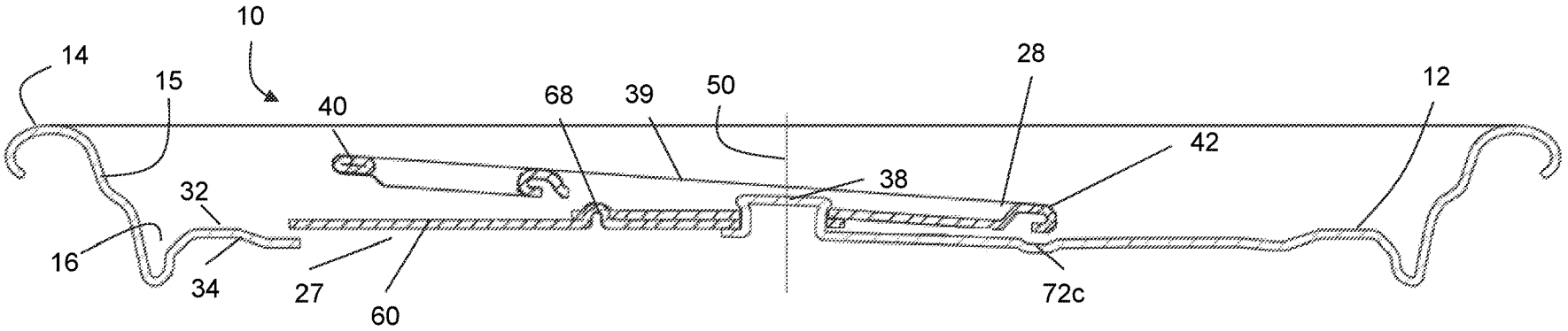
FIG. 7A is cross-section of an embodiment of a can end having a reclosable cover in a closed condition, illustrating a skew in the can end which adversely affects reclosability of the pour opening.
Figure 7B:
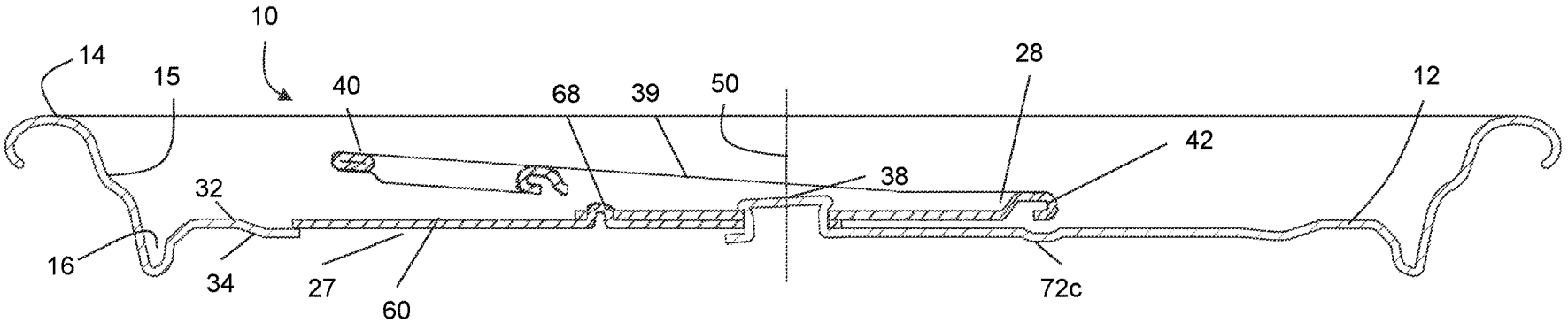
FIG. 7B is cross-section of an embodiment of a can end having a reclosable cover in a closed condition, illustrating a skew in the can end which adversely affects reclosability of the pour opening.

As shown in FIGS. 5 and 6, the pour opening 27 can be reclosed by the cover 60 by simple rotation of the tab 28. A portion of the cover 60 is positioned and fits within a space created by beam form of the tab 28 configured in an inverted u-shape. However, as depicted in FIGS. 7A and 7B, such factors as material properties and the opening process, alone or in combination, can cause the cover 60 to skew in a direction parallel to the longitudinal axis 50 or skew due to the torque during opening. These factors can cause the cover 60 to improperly seat over or within the pour opening 27. This could cause leakage when attempts are made to reclose the pour opening 27.

Referring to FIGS. 8-20, the present disclosure provides alternative structural modifications, which, alone or in combination, can reduce or eliminate the effects causing poor reclosability of the pour opening 27. These modifications can be made to the cover 60 or the center panel 12 as will be discussed below.

The center panel 12 can be outfitted with one or more upwardly extending and downwardly extending beads 72. These beads 72 can be used alone or in combination to improve seal around the rivet 38 as shown In FIGS. 8-20. Structurally, the beads 72 are simply a plastically deformed region of the can end 10 which moves a segment of the can end 10 either upwardly or downwardly out of plane relative to portions of the can end 10 surrounding the beads 72. In the figures, beads are generally identified by the reference numeral 72. Specific up-beads and down-beads are identified as 72*a*, 72*b*, 72*c*, etc.

In one embodiment, an up-bead 72*a* is formed in the center panel 12 on the tear panel 22. This up-bead 72*a* is positioned under the nose portion 42 of the tab 28 when the tab 28 is in the frangible score breaking position prior to creating the pour opening 27, as shown in, for example, FIGS. 5, 10, 12, etc. This up-bead 72*a* decreases a distance between the nose portion 42 of the tab 28 and the tear panel 22 such that the nose portion 42 contacts the tear panel 22 sooner during the score opening procedure. This is thought to improve openability of the tear panel 22. This up-bead 72*a* can have a crescent shape and has a length of at least 0.25 inches (6.35 mm)

Figure 22:
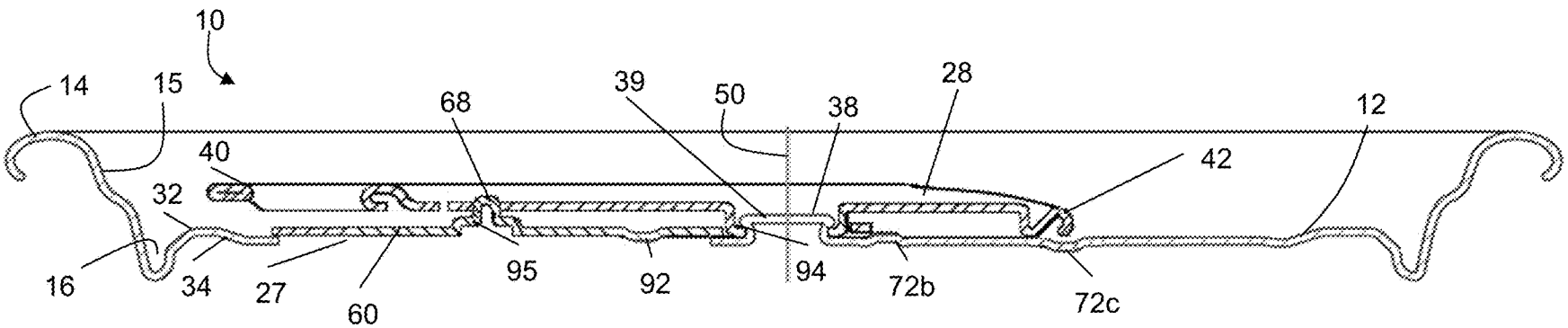
FIG. 22 is a cross-section of an embodiment of a can end having a reclosable cover in a pour opening closed position.
Figure 23:
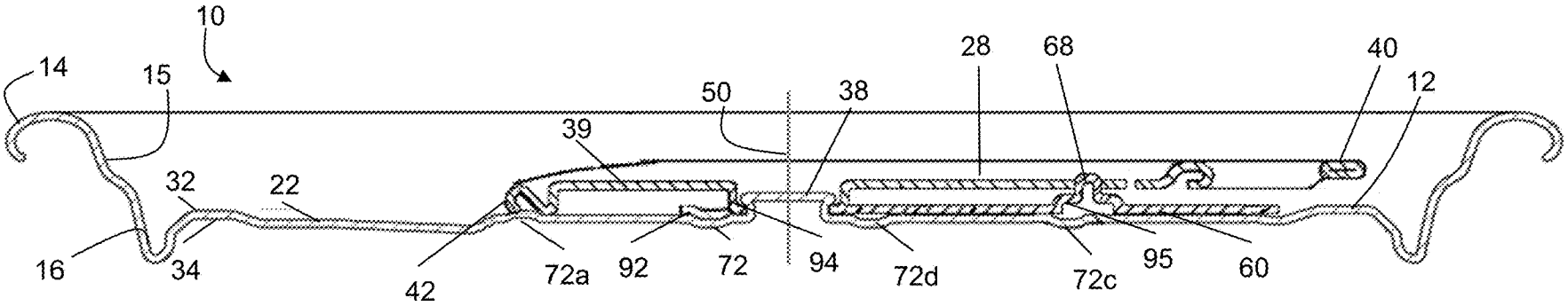
FIG. 23 is a cross-section of an embodiment of a can end having a reclosable cover in a ready-to-open, frangible score breaking position.
Figure 24:
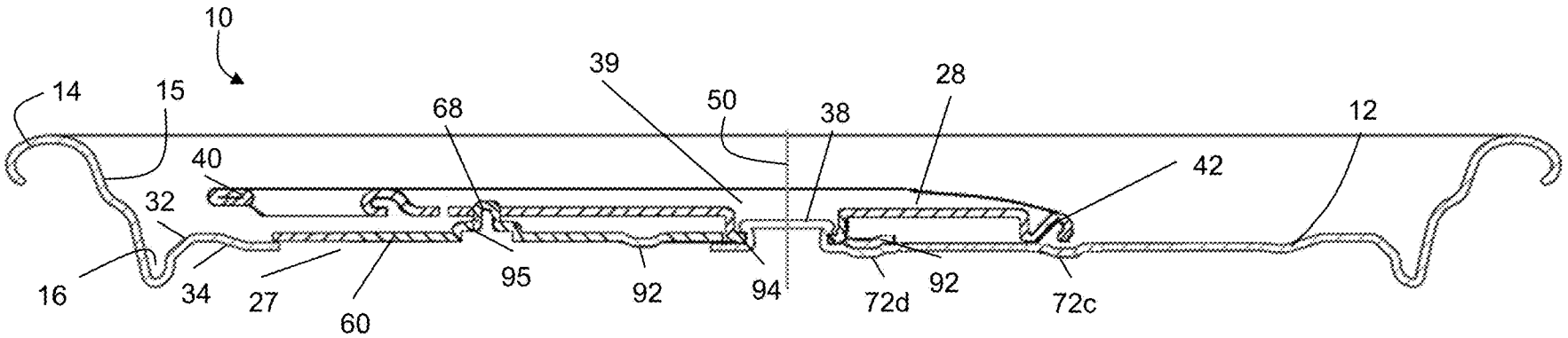
FIG. 24 is a cross-section of an embodiment of a can end having a reclosable cover in a pour opening closed position.

As illustrated, for example, in FIGS. 5 and 6, a down-bead 72*c* can be placed in the center panel 12 at a distance from the rivet 38 corresponding to a distance from the rivet 38 at which the nose portion 42 of the tab 28 is positioned when the tab 28 is rotated to create a reclosed condition of the pour opening 27. In the closed condition, the cover 60 is placed over or within the pour opening 27 to effectively reclose the pour opening. The term "effectively' is intended to encompass a situation where a beverage encounters resistance from the cover 60 and cannot freely flow through the pour opening 27 when the container is tipped to one side or another. In this embodiment, the down-bead 72*c* creates a detent which is configured, as in sized and shaped, to receive the nose portion 42 of the tab 28 once the tab 28 has been rotated to place the can end in the reclosed condition. The nose portion 42 within the down-bead 72*c* is shown in, for example, FIG. 22 or FIG. 24. This structural relationship depends upon the deflection and plastic deformation the tab 28 undergoes during the opening sequence and may be realized in, for example, the embodiment illustrated in FIGS. 5 and 6, as well as any other illustrated embodiment having a down-bead 72*c* so located.

Figure 9:
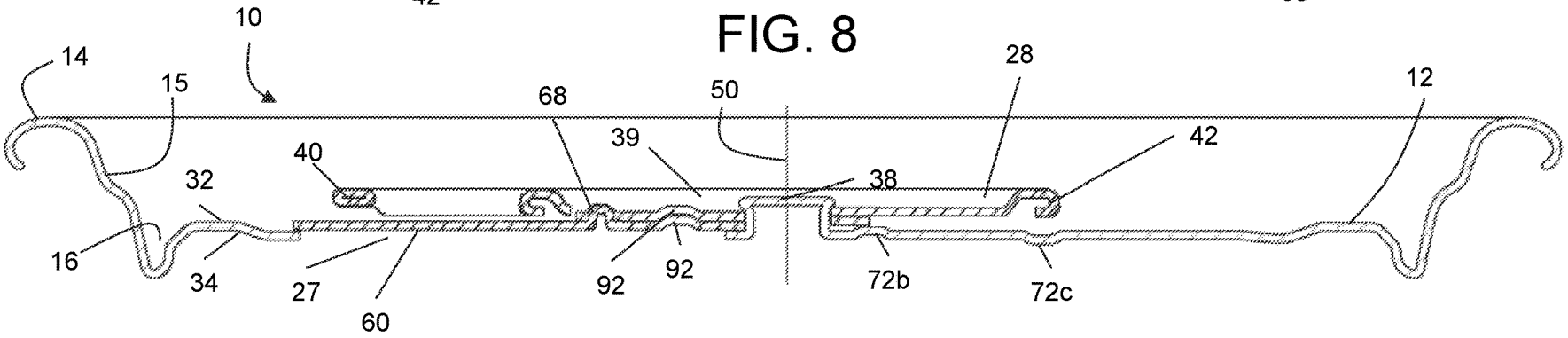
FIG. 9 is a cross-section of an embodiment of a can end having a reclosable cover in a pour opening closed position.
Figure 14:
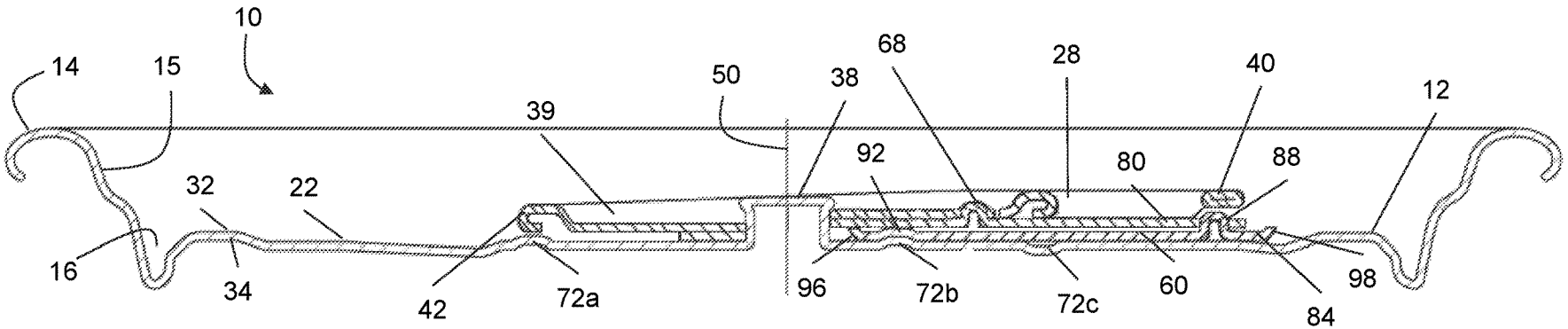
FIG. 14 is cross-section of an embodiment of a can end having a reclosable cover in a ready-to-open, frangible score breaking position.
Figure 15:
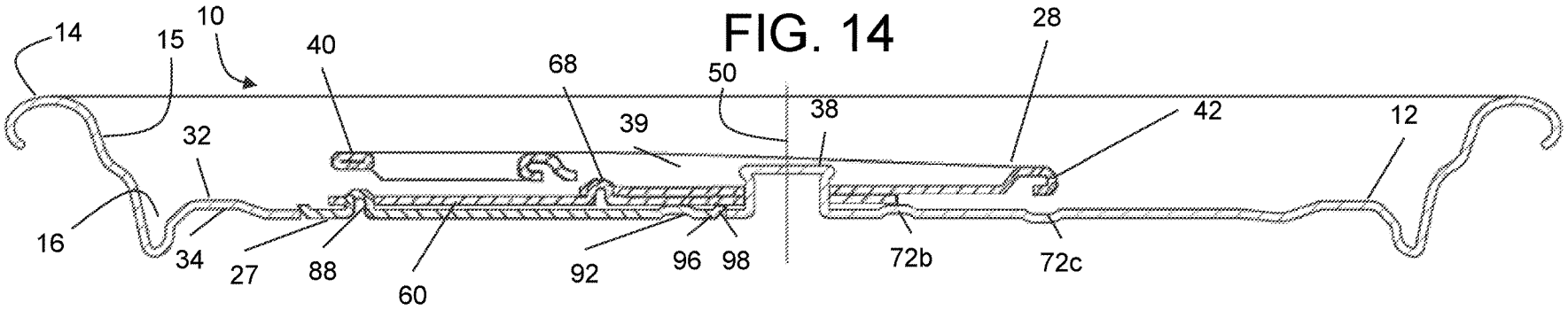
FIG. 15 is a cross-section of an embodiment of a can end having a reclosable cover in a pour opening closed position.

As illustrated in, for example, FIGS. 8, 9, 14, and 15, the can end 10 can have an up-bead 72*b* positioned near the rivet 38 opposite the tear panel 22 in relation to the rivet 38. As shown in FIGS. 9 and 15, this up-bead 72*b* is configured to engage a portion of one of the rivet island 38 or the cover 60. Generally, this up-bead 72*b* engages a portion of the cover 60 located between the rivet island 39 and the center panel 12. This engagement between the tab 28 and the up-bead 72*b* deflects an opposite end of the cover 60 to better seal the pour opening 27 when the tab 28 is rotated to place the can end 10 in the reclosed condition.

Figure 10:
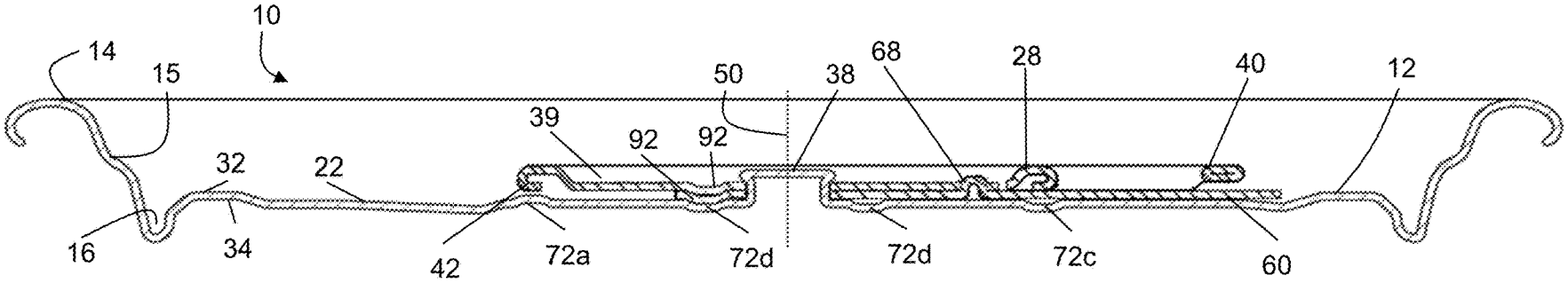
FIG. 10 is cross-section of an embodiment of a can end having a reclosable cover in a ready-to-open, frangible score breaking position.
Figure 11:
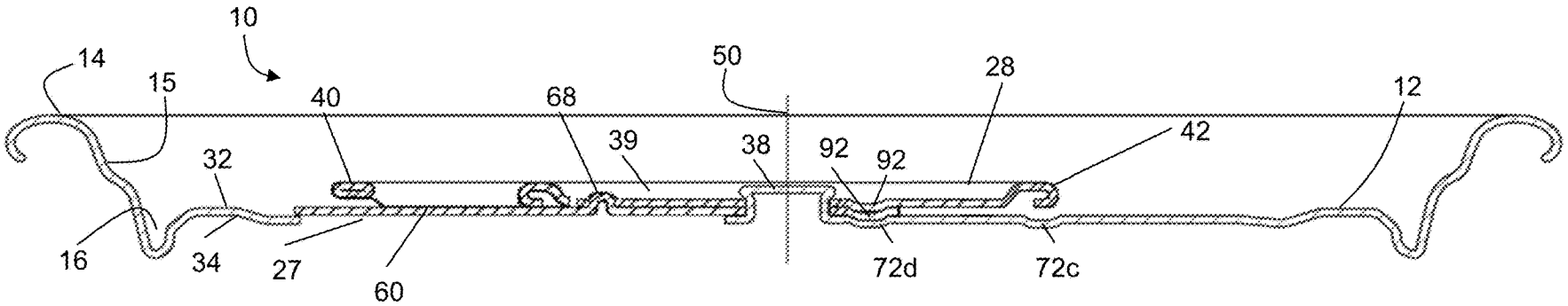
FIG. 11 is a cross-section of an embodiment of a can end having a reclosable cover in a pour opening closed position.

As illustrated in, for example, FIGS. 10 and 11, the can end 10 can have a down-bead 72*d* positioned near the rivet 38 on an opposite side of the center panel 12 as the tear panel 22 in relation to the rivet 38. As shown in FIG. 11, this down-bead 72*d* is configured to receive a corresponding portion of one of the rivet island 29 or the cover 60. Generally, a portion of the cover 60 beneath rivet island 39 is received with the down-bead 72*d* such that the arrangement provides a better seal around the rivet 38 and consequently a better seal of the pour opening 27 when the tab 28 is rotated to place the can end 10 in the reclosed condition. The tear panel 22 also comprises a down-bead 72*d* located on an opposite side of the rivet 38 as the down-bead 72*d* near the rivet 38 wherein the down-bead 72*d* on the tear panel 22 is configured to receive a down-bead on one of the rivet island 39 or the cover 60 when the nose portion 42 of tab 28 is in the frangible score breaking position.

As illustrated in, for example, FIGS. 16-20, the center panel 12 can have a platform 76 formed thereon. The platform 76 extends in one of an upwardly or downwardly direction parallel to the longitudinal axis. The platform displaces a portion of the center panel 12 comprising the tear panel 22 such that a height of the entirety of the tear panel 22 in relation to a portion of the center panel 12 immediately surrounding the rivet 38 is located at a different height than the tear panel 12.

Figure 16:
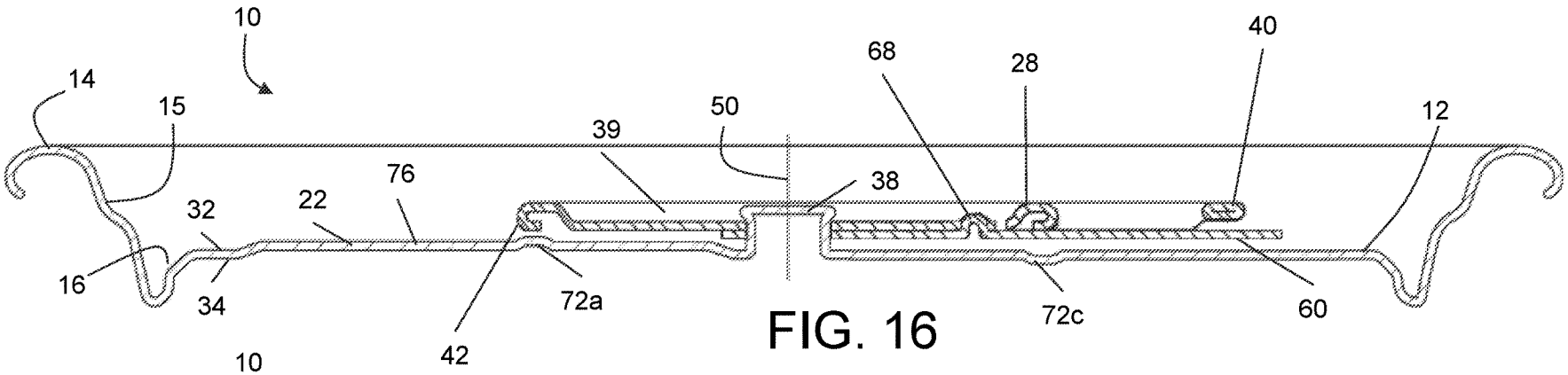
FIG. 16 is a cross-section of an embodiment of a can end having a reclosable cover in a pour opening closed position.
Figure 17:
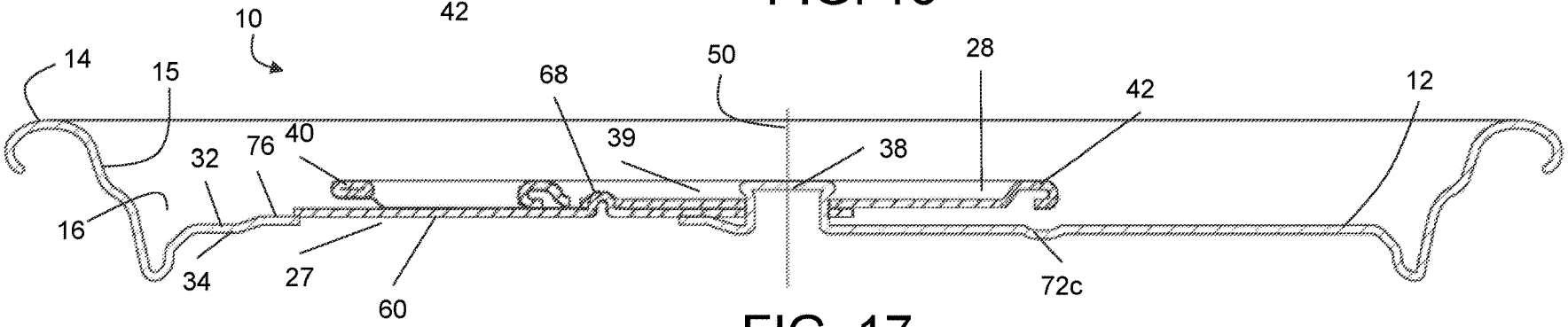
FIG. 17 is a cross-section of an embodiment of a can end having a reclosable cover in a pour opening closed position.
Figure 19:
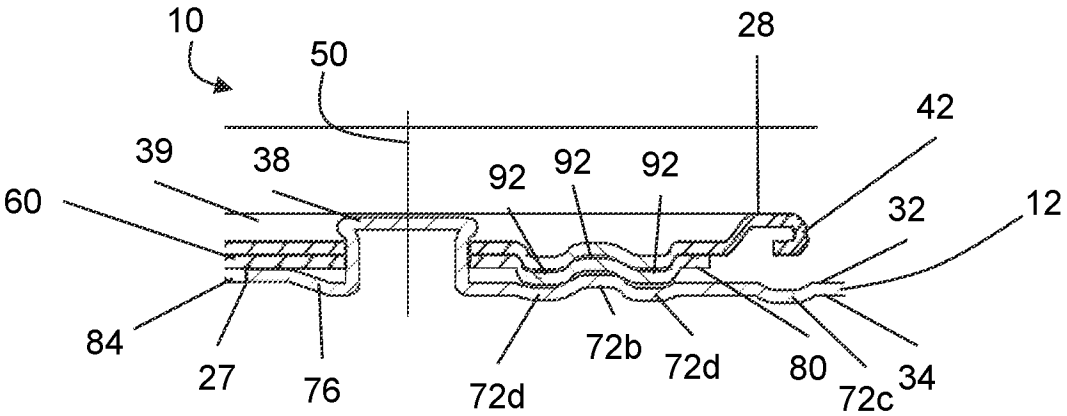
FIG. 19 is a partial cross-section of an embodiment of a can end having a reclosable cover in a pour opening closed position.

In one embodiment illustrated in FIGS. 16, 17, and 19, the platform 76 extends upwardly in a direction parallel to the longitudinal axis 50. The frangible score 24 and the tear panel 22 reside upon the platform 76. Thus, this upwardly extending platform 76 displaces the pour opening 27 upwardly, decreasing a distance between the cover 60 and the pour opening 27 in the reclosed condition. As illustrated, the platform 76 of this embodiment has an uppermost surface on which the tear panel 22 lies that is elevated above a remaining portion of the center panel 12. Thus, the height of the entirety of the tear panel 22 is higher than a portion of the center panel 12 immediately surrounding the rivet 38. "Immediately" as used in this case is intended to encompass the region within a coined surface surrounding the rivet 38 which is an understood by-product of rivet 38 forming.

Figure 18:
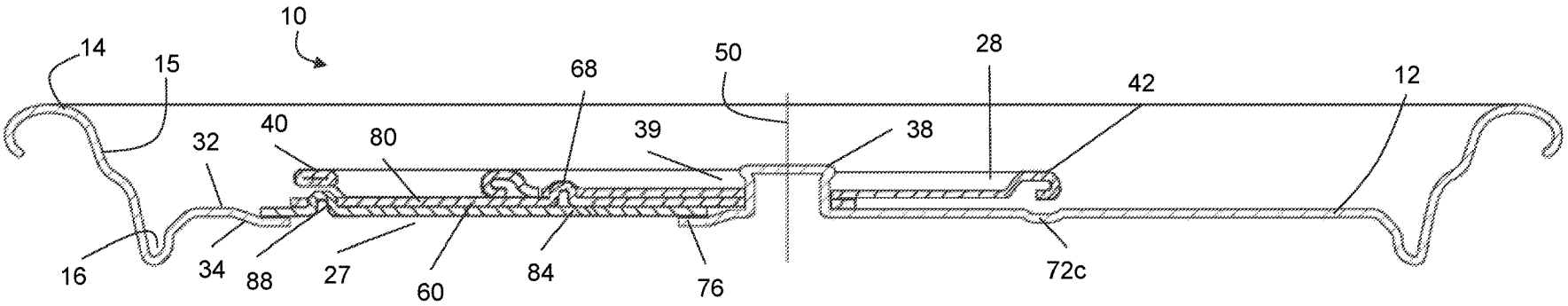
FIG. 18 is a cross-section of an embodiment of a can end having a reclosable cover in a pour opening closed position.
Figure 20:
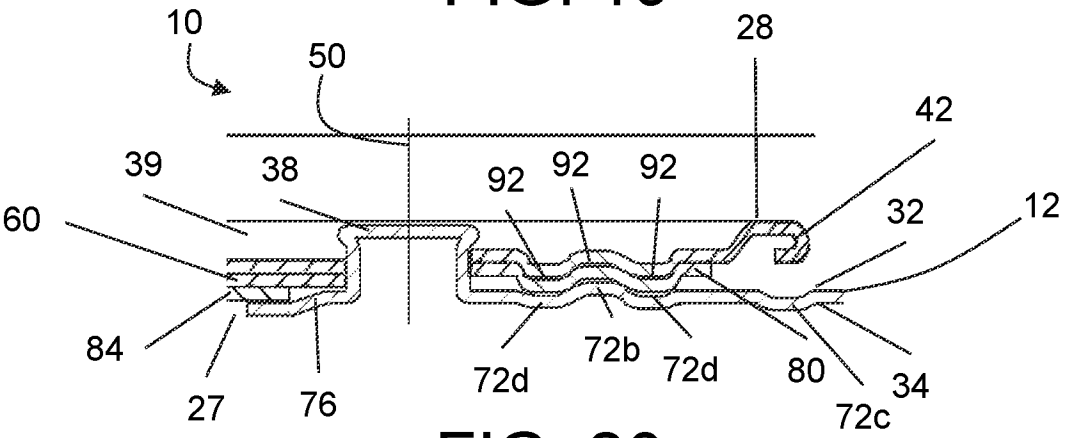
FIG. 20 is a partial cross-section of an embodiment of a can end having a reclosable cover in a pour opening closed position.
Figure 21:
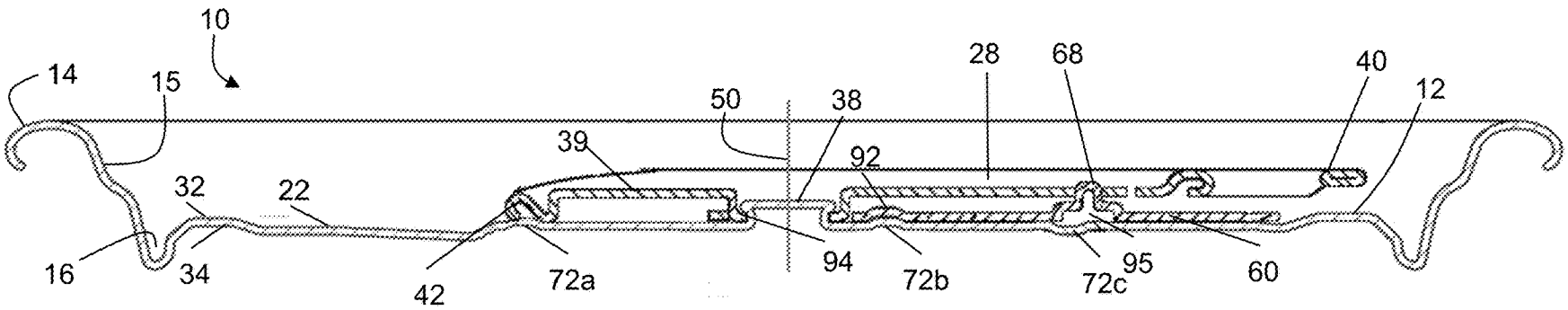
FIG. 21 is a cross-section of an embodiment of a can end having a reclosable cover in a ready-to-open, frangible score breaking position.

A can end 10 having a recessed platform 76 is illustrated in FIGS. 18 and 20. Here, the platform 76 lowers the frangible score 24, tear panel 22, and pour opening 27 below remaining portions of the center panel 12. It follows that the platform 76 extends downwardly in a direction parallel to the longitudinal axis 50. This arrangement provides increased clearance between the center panel 12 and the cover 60 which facilitates rotation of the tab 28 and cover 60 to place the can end 10 in the reclosed condition. Thus, the height of the entirety of the tear panel 22 is lower than a portion of the center panel 12 immediately surrounding the rivet 38.

It is further contemplated that the tab 28 and the cover 60 can be arranged to achieve a better seal of the pour opening 27. Again, these features can be used alone or in combination with the features on the center panel 12 to improve the seal of the cover 60 over or within the pour opening 27.

In an embodiment, the cover 60 is a unitary member attached to the tab 28, for example, by the rivet 68.

Referring specifically to FIGS. 8 and 9, the center panel 12 has an up-bead 72*b* near the rivet 38 which stakes the tab 28 to the rest of the center panel 12. In the frangible score breaking position, the rivet island 39 and the cover 60 have corresponding upwardly projecting beads 92 configured, as in sized and shaped, to accommodate the up-bead 72*b*. Alternatively, these features can be left off, and the up-bead 72*b* will deflect the nose portion 42 of the tab 28 downwardly towards the tear panel 22.

In other embodiments illustrated in FIGS. 12-15, the cover 60 comprises an intermediate member 80 attached to the tab 28 and a closure 84 attached to the intermediate member 80, thus joining it to the tab 28 to be rotational therewith. In the embodiments illustrated, the intermediate member 80 is attached to the tab 28 by the rivet 68, and the closure member 84 is attached to the intermediate member 80 by another rivet 88. It follows that the closure member 84 is rotational upon a rotational movement provided to the tab 28 and vice versa to place the can end 10 in the reclosed condition.

The intermediate member 80 has two apertures. One aperture below the rivet island 39 receives the rivet 38 formed from the center panel 12. A second aperture receives the rivet 88 produced from the closure 84 which joins the closure 84 to the intermediate member 84

The rivet island 39 of the tab 28 also has two apertures. One aperture receives rivet 38, and the second aperture receives rivet 68 is formed from the intermediate member 80.

Figure 12:
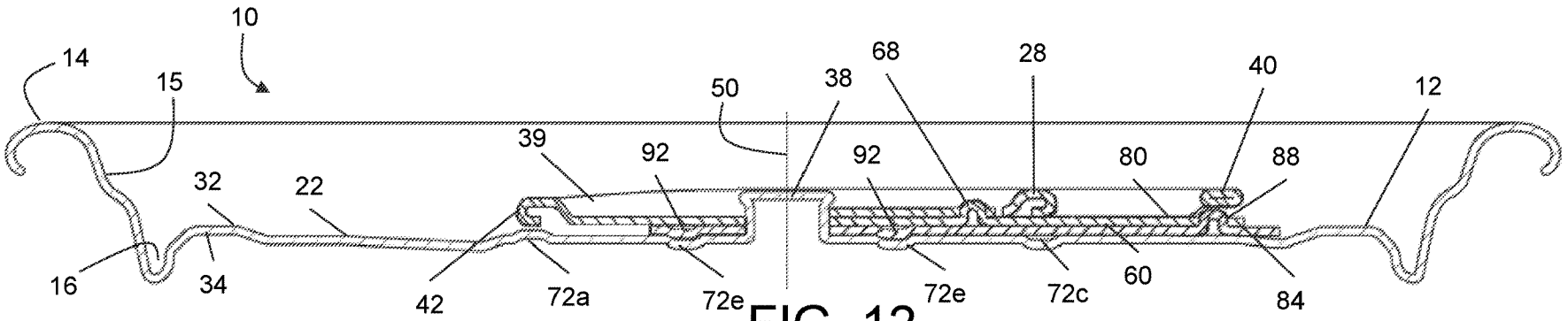
FIG. 12 is cross-section of an embodiment of a can end having a reclosable cover in a ready-to-open, frangible score breaking position.
Figure 13:
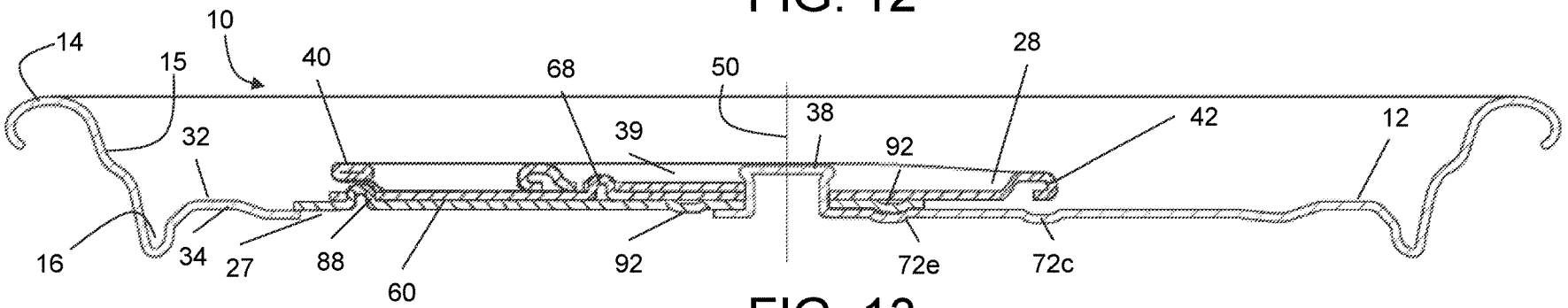
FIG. 13 is a cross-section of an embodiment of a can end having a reclosable cover in a pour opening closed position.

Referring specifically to FIGS. 12 and 13, the center panel 12 has a down-bead 72*e* near the rivet 38 which stakes the tab 28 to the rest of the center panel 12. In the frangible score breaking position, the intermediate member 80 has a corresponding downwardly projecting bead 92 configured, as in sized and shaped, to be received within a corresponding down-bead 72*e* on the tear panel 22. In the reclosed position shown in FIG. 13, the downwardly projecting bead 92 is received within the down-bead 72*e* in the remaining portion of the center panel 12 on an opposing side of the rivet 38.

Referring specifically to FIGS. 14 and 15, the cover 60 comprises the intermediate member 80 and the closure 84 in the manner previously described. Here, the closure 84 has a flared peripheral edge forming an upwardly and radially outwardly angled circumferential flange 96 which allows the closure member 84 to fit within the pour opening 27 as depicted in FIG. 15. The flange 96 engages the material defining the shape of the pour opening 27 to reclose the can end 10. A portion of the flange 96 is positioned within the pour opening 27 between the product side 34 and the public side 32 of the center panel 12 when the can end 10 is in the reclosed condition. The flange 96 contacts a severed edge of the center panel 12 created by a fracture of the frangible score 24 during opening of the can end 10 and which defines at least a portion of the pour opening 27. This flange 96 creates a concave cover 60 when viewed from the public side 32 of the center panel 12 creating a deboss panel on the cover surface.

The flange 96 may include a sealing material 98 on its product side to enhance a seal between the closure 84 and the center panel 12. The sealing material 98 is produced from at least one of an epoxy or polymeric material. In the frangible score breaking position of this embodiment, the closure 84 may have an upwardly projecting up-bead 92 to accommodate an up-bead 72*b* in the center panel 12 near the rivet 38.

Referring specifically to the embodiment illustrated in FIG. 19, in the reclosed condition, the rivet island 39 near the nose portion of the tab 28, and the intermediate portion 80 of the cover 60 have up- and down-beads to mate with corresponding up- and down-beads on the center panel 12. The closure 84 fits within the pour opening 27 on a raised platform 76 to reclose the can end 10.

Referring specifically to the embodiment illustrated in FIG. 20, in the reclosed condition, the rivet island 39 near the nose portion of the tab 28, and the intermediate portion 80 of the cover 60 have up- and down-beads 92 to mate with corresponding up- and down-beads 72 on the center panel 12. The closure 84 closes the pour opening 27 by engaging the center panel 12 surrounding the pour opening 27. The entirety of the pour opening 27 is recessed on a lowered platform 76.

Figure 25:
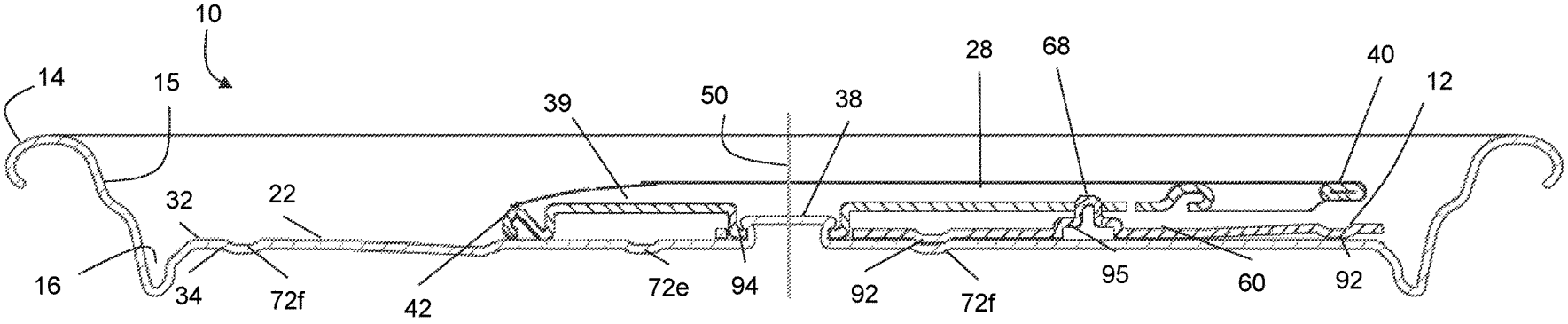
FIG. 25 is a cross-section of an embodiment of a can end having a reclosable cover in a ready-to-open, frangible score breaking position.
Figure 26:
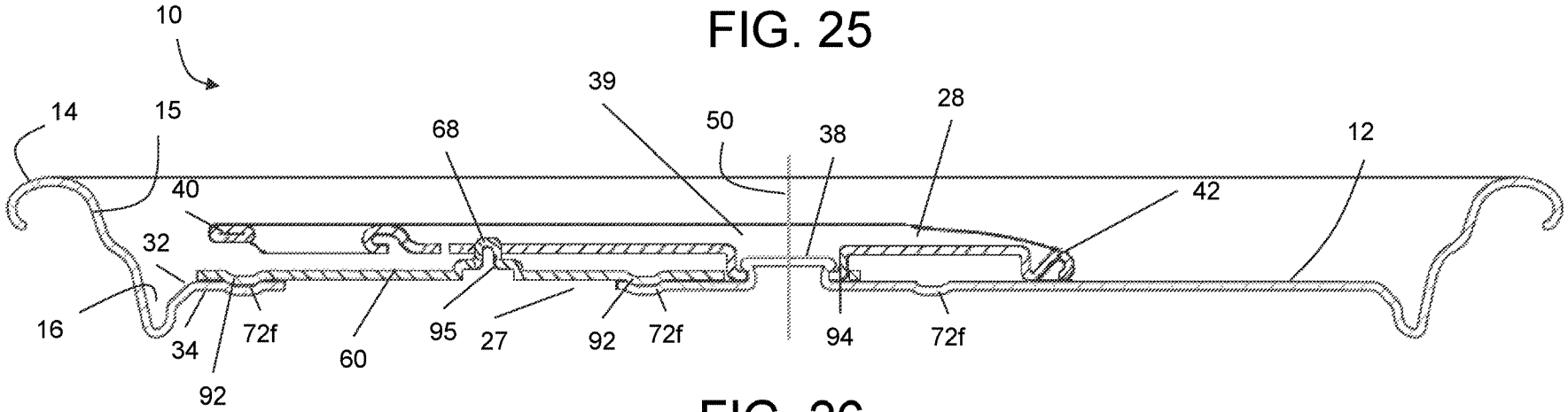
FIG. 26 is a cross-section of an embodiment of a can end having a reclosable cover in a pour opening closed position.

As depicted in FIGS. 1-3, the central panel 12 has one or more beads 72 located adjacent the frangible score 24, preferably substantially surrounding the pour opening 27 after the frangible score 24 has been fractured. These beads 72 can be up-beads or down-beads. The cover 60 has one or more complimentary beads 92 which fit within or over beads 72. Referring specifically to the embodiments illustrated in FIGS. 25 and 26, the center panel 12 has one or more down-beads 72*f* substantially surrounding the tear panel 22 in FIG. 25 in the ready-to-open position and substantially surrounding the pour opening 27 in FIG. 26 with the cover in the reclosed condition of the can end 10. The cover 60 has one or more complimentary beads 92 which fit within the down-beads 72*e*. Here, "substantially" is intended to encompass at least 90 percent of a circumference of the pour opening 27.

According to embodiments displayed in FIGS. 21-28, the tab 28 has a rivet well 94. The rivet well 94 is concave when viewed from the perspective above the can end 10. It extends downwardly towards the public side 32 of the center panel 12. The tab 28 has a rivet aperture recessed in the rivet well 94 and the cover 60 rivet aperture that receives the rivet 39 also receives the rivet well 94 therein.

Similarly, the cover 60 has a convex extension 95. This forms a concave feature on the bottom of the cover 60. The extension increases a height of rivet 68 such that the rivet 68 is engageable with the rivet island 39 and can pass through the rivet aperture therein.

Figure 27:
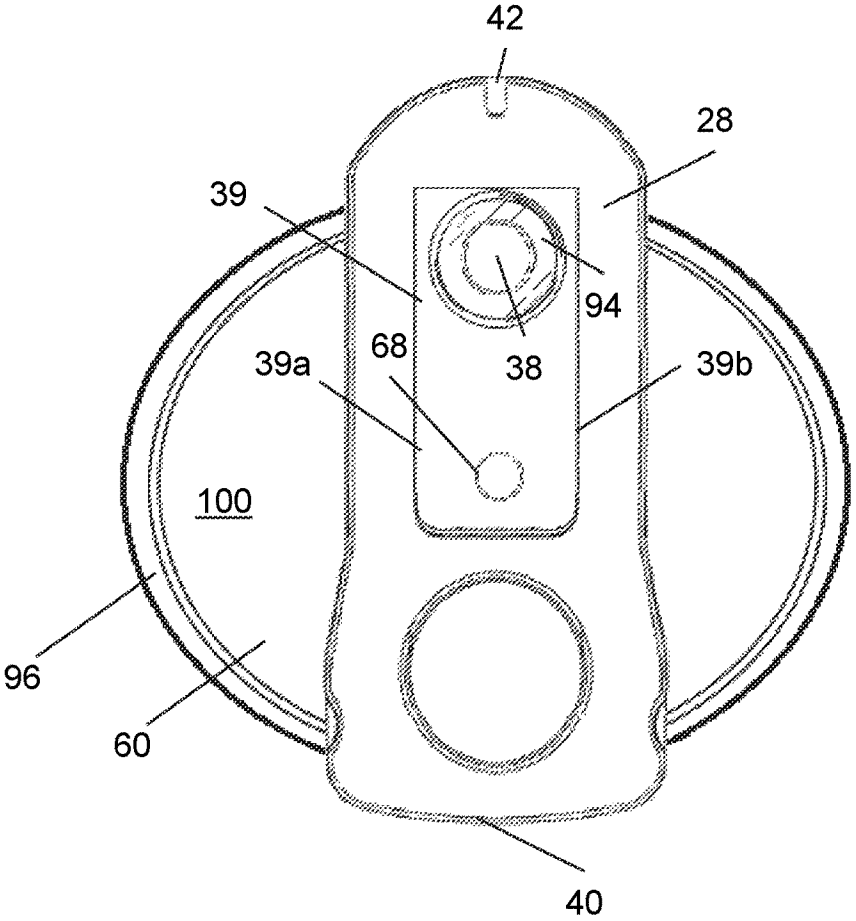
FIG. 27 is a top view of a tab which can be provided on a can end of the invention in a ready-to-open, frangible score breaking position.

As illustrated in FIGS. 27 and 28, the cover 60 can have a convex shape. Here, the flange 96 extends downwardly from adjacent regions of the cover 60 such that the public side of a central surface 100 of the cover 60 has a height along the longitudinal axis 50 greater than a height of the flange 96.

Figure 33:
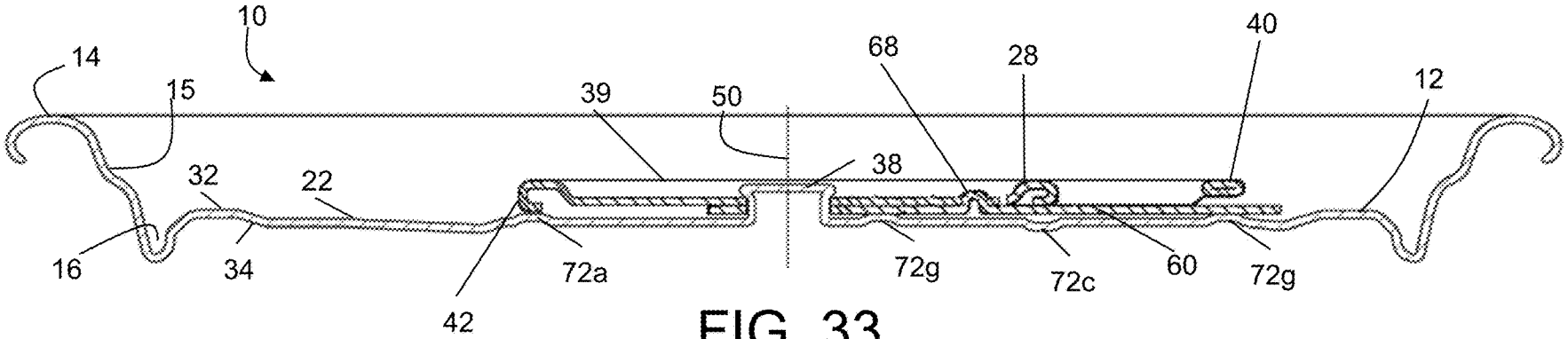
FIG. 33 is a cross-section of an embodiment of a can end having a reclosable cover in a ready-to-open, frangible score breaking position.
Figure 34:
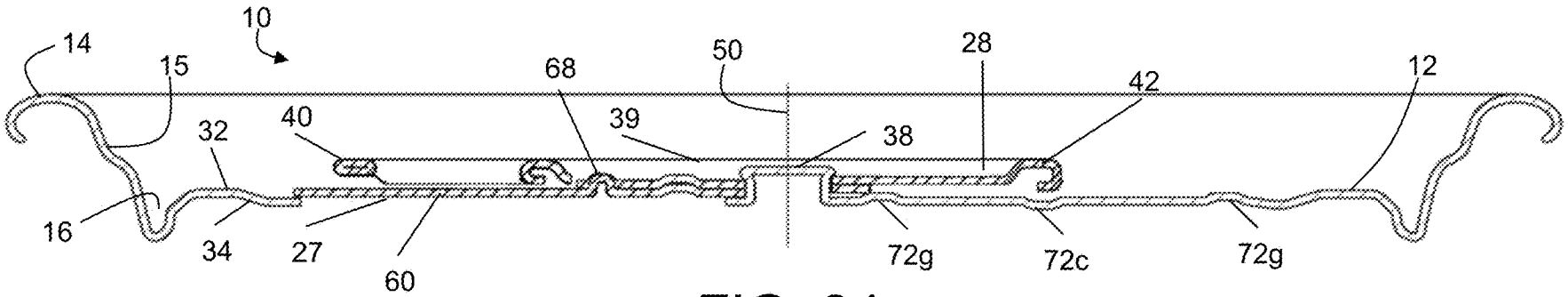
FIG. 34 is a cross-section of an embodiment of a can end having a reclosable cover in a pour opening closed position.

As illustrated in FIGS. 33 and 34, in the ready-to-open, frangible score breaking position, the can end 10 may have one or more protrusions, such as up-beads 72*g* which engage a bottom side of the cover 60 to maintain a space or gap between the cover 60 and the public side 32 of the can end 10, typically the center panel 12. The protrusions prop up the cover 60 slightly from the public side 32 of the center panel 12. This creates an air channel for the cover 60 so product (liquid) is not trapped between the cover 60 and center panel 12 during container filling and double seaming operations when the can end 10 is attached to a container body filled with product. This feature can include a series of protrusions or a lone protrusion. The protrusions lie beneath the cover 60 when the can end is in its original closed position (score unopened).

Figure 36:
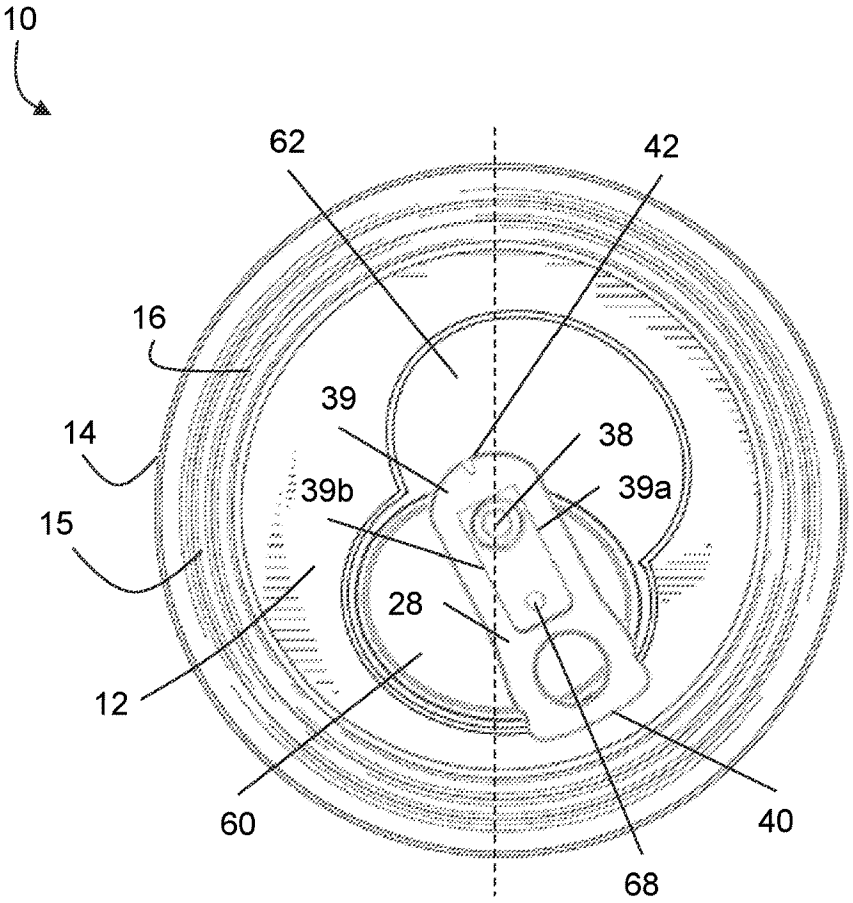
FIG. 36 is a top view of a can end having a reclosable cover with a tab and the cover rotated over a concealed pour opening to create a reclosed condition of the can end.
Figure 35:
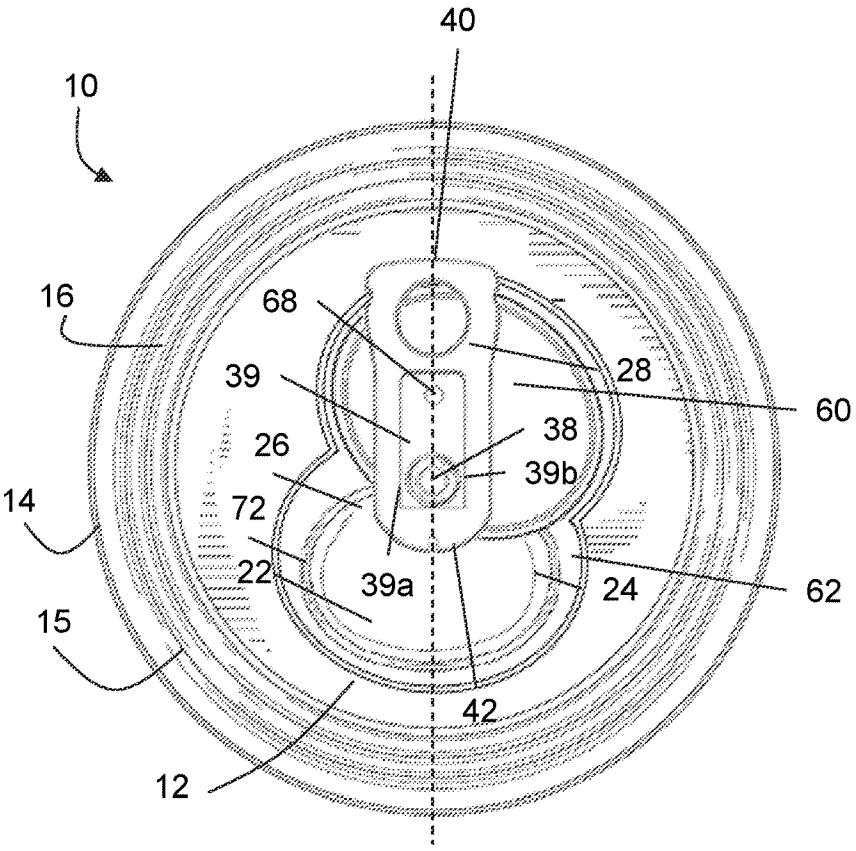
FIG. 35 is a top view of a can end having a reclosable cover with a tab in a ready-to-open, frangible score breaking position.

Referring to FIGS. 35 and 36, a can end 10 has a cover 60 that is offset to a side of the tab 28. The cover 60 is asymmetrically skewed in relation to the tab 28. The rivet 68 which attaches the tab 28 to the cover 60 is also skewed to one side on the cover 60, such that it is closer to one edge of the cover 60 on a first side of the cover 60 than an edge on an opposite side of the cover 60. Here, a tab rotation of less than 180 degrees places the cover 60 over the pour opening 27 (compare FIG. 35 to FIG. 36). A position of the cover 60 on the center panel 12 when the tab 28 is in the frangible score breaking position is asymmetrically located in relation to the tab 28 wherein a first surface area of the cover 60 is located on a first side of a diametrical axis which passes through the lift end 40 of the tab 28, through the rivet 38, intersecting the longitudinal axis 50, and through the nose portion 42 of the tab 28 when the tab 28 is in the frangible score 24 breaking position is greater than a second surface area of the cover 60 located on a second side of the diametrical axis.

This embodiment may have the structural characteristics of the beads 72 previously described. To accommodate the offset cover 60, the deboss panel 62 is irregularly shaped such that it is asymmetrical to the diametrical axis (as shown in FIG. 35).

It is contemplated that the embodiment shown in FIGS. 35 and 36 may be easier for a user to operate, both during opening by making the tab easier to access and when the can end is placed on the reclosed condition by requiring fewer degrees of rotation by the tab and the cover 60.

In one embodiment, a thickness of the material in the tab 28 is to achieve better spring-back on the metal tab 28.

In one embodiment, a bead is created adjacent the frangible score to improve rigidity of the metal adjacent the frangible score region to reduce plastic deformation of the material immediately adjacent the pour opening 27, see, for example, FIGS. 1 and 3.

In one embodiment, indicia such as printing, incising, or stamped cut-outs can be displayed on the tab 28 or under the cover 60 when the can end 10 is in the pour opening 27 closed condition.

While the specific embodiments have been illustrated and described, numerous modifications come to mind without significantly departing from the spirit of the invention, and the scope of protection is only limited by the scope of the accompanying Claims.

What is claimed is:

1. A can end (10) for enclosing a container body comprising:

a curl (14) extending circumferentially about a longitudinal axis (50);

a circumferential wall (15) extending downwardly from a radially inner portion of the curl (14);

a circumferential strengthening member (16) joined to lower segment of the circumferential wall (15)

a center panel (12) about which the circumferential strengthening member (16) extends having a public side (32) opposite a product side (34), the center panel (12) comprising;

a peripheral edge defining a radially outer perimeter of the center panel (12);

a tear panel (22) spaced radially inwardly from the peripheral edge, the tear panel (22) defined by a frangible score (24) in the public side (32) and non-frangible hinge segment located between terminal ends of the frangible score (24); and a rivet (38);

a tab (28) is attached to the center panel (12) by the rivet (38), wherein the tab (28) is configured to rotate about the rivet (38), the tab (28) comprising:

a lift end (40) opposite a nose portion (42) overlaying the tear panel (22) in a frangible score (24) breaking position;

a rivet island (39) having a rivet aperture through which the rivet (38) passes to attach the tab (28) to the center panel (12);

a void region partially surrounding the rivet island (39) having a first leg (39*a*) extending along a first side of the rivet island (39) and a second leg (39*b*) extending along a second side of the rivet island (39); and a tab hinge extending between respective terminal ends of the first and second legs (39*a*,39*b*) of the void region;

a cover (60) is attached to the tab (28) and is rotational therewith, wherein the frangible score (24) is breakable to form a pour opening (27) in the center panel (12), and the cover (60) is rotatable to overlay the pour opening (27) and effectively reclose the pour opening (27) in a reclosed condition of the can end (10), the center panel (12) comprises a bead near the rivet (38) and opposite the tear panel (22) in relation to the rivet (38), wherein the bead is located beneath the rivet island (39) of the tab (28) when the can end (10) is in the reclosed condition, wherein the bead near the rivet (38) is an up-bead and engages one of the rivet island (39) or the cover (60) when the can end (10) is in the reclosed condition, wherein a downward deflection of a portion of the cover (60) located over the pour opening (27) caused by an engagement of the one of the rivet island (39) or the cover (60) with the up-bead effectively recloses the pour opening (27) when the tab (28) is rotated to place the can end (10) in the reclosed condition.

2. The can end (10) of claim 1 wherein the center panel (12) comprises a plurality of beads formed on a side of the center panel (12) opposite the tear panel (22) in relation to the rivet (38), wherein each bead of the plurality of beads is one of an up-bead or a down-bead, and each bead of the plurality of beads is positioned beneath the rivet island (39) of the tab (28) when the can end (10) is in the reclosed condition and each of the plurality of beads engages one of the rivet island (39) or the cover (60) when the can end (10) is in the reclosed condition.

3. The can end (10) of claim 1 wherein the tab (28) comprises downwardly extending legs along the first and second sides of the rivet island (39) defining a space between the public side (32) of the center panel (12) and a bottom side of the tab (28), wherein the cover (60) is positioned within the space.

4. The can end (10) of claim 1 wherein the center panel (12) further comprises a platform extending in one of an upwardly or downwardly direction parallel to the longitudinal axis (50), the platform displacing a portion of the center panel (12) comprising the tear panel (22) such that a height of the entirety of the tear panel (22) in relation to a portion of the center panel (12) immediately surrounding the rivet (38) is located at a different height than the tear panel (22).

5. The can end (10) of claim 4 wherein the height of the entirety of the tear panel (22) is higher than a portion of the center panel (12) immediately surrounding the rivet (38).

6. The can end (10) of claim 4 wherein the height of the entirety of the tear panel (22) is lower than a portion of the center panel (12) immediately surrounding the rivet (38).

7. The can end (10) of claim 1 wherein the cover (60) comprises:

an intermediate member attached to the tab (28); and a closure attached to the intermediate member and attached to the tab (28) by attachment of the closure to the intermediate member such that the closure member is rotatable upon rotation of the tab (28).

8. The can end (10) of claim 7 wherein the intermediate member is attached to the tab (28) by a rivet.

9. The can end (10) of claim 7 wherein the closure is attached to the intermediate member by a rivet.

10. The can end (10) of claim 9 wherein the cover (60) comprises a circumferential flange angled upwardly and radially outwardly relative to a center portion of the cover (60).

11. The can end (10) of claim 10 wherein the circumferential flange contacts a severed edge of the center panel (12) created by a fracture of the frangible score (24) during opening of the can end (10) and which defines at least a portion of the pour opening (27).

12. The can end (10) of claim 11 wherein the circumferential flange comprises a sealing material produced from at least one of an epoxy or polymeric material.

13. The can end (10) of claim 1 wherein the cover (60) is asymmetrically skewed in relation to the tab (28), wherein a rotation of the tab (28) of less than 180 degrees is required to place the cover (60) over the pour opening (27) in the reclosed condition of can end (10).

14. The can end (10) of claim 13 wherein a position of the cover (60) on the center panel (12) when the tab (28) is in the frangible score (24) breaking position is asymmetrically located in relation to the tab (28) wherein a first surface area of the cover (60) is located on a first side of a diametrical axis which passes through the lift end (40) of the tab (28), through the rivet (38), intersecting the longitudinal axis (50), and through the nose portion of the tab (28) when the tab (28) is in the frangible score (24) breaking position is greater than a second surface area of the cover (60) located on a second side of the diametrical axis.

15. The can end (10) of claim 14 wherein the tab (28) is attached to the cover (60) at a location on the cover (60) that is closer to one edge of the cover (60) on a first side of the cover (60) than an edge on an opposite side of the cover (60).

16. The can end (10) of claim 15 wherein a deboss panel is asymmetrically skewed in relation to the diametrical axis.

17. The can end (10) of claim 1 wherein the cover (60) is attached to the rivet island (39) of the tab (28).

18. The can end (10) of claim 17 wherein the cover (60) is attached to the rivet island (39) by a rivet.

19. The can end (10) of claim 18 wherein the rivet attaching the cover (60) to the rivet island (39) is formed from a material of the rivet island (39) and extends downwardly towards the center panel (12).

* * * * *